US008786525B2

(12) United States Patent
Mizutani et al.

(10) Patent No.: US 8,786,525 B2
(45) Date of Patent: Jul. 22, 2014

(54) LIGHT EMITTING DEVICE, DRIVE CONTROL METHOD THEREOF, AND ELECTRONIC DEVICE

(75) Inventors: Yasushi Mizutani, Musashimurayama (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 303 days.

(21) Appl. No.: 13/238,240

(22) Filed: Sep. 21, 2011

(65) Prior Publication Data

US 2012/0068986 A1 Mar. 22, 2012

(30) Foreign Application Priority Data

Sep. 22, 2010 (JP) ..... 2010-212844
Sep. 30, 2010 (JP) ..... 2010-221480

(51) Int. Cl.
*G09G 3/30* (2006.01)

(52) U.S. Cl.
USPC ..... 345/77; 345/204; 345/211

(58) Field of Classification Search
CPC ..... G09G 3/3233; G09G 2320/043
USPC ..... 345/204, 211, 77
See application file for complete search history.

(56) References Cited

U.S. PATENT DOCUMENTS

2005/0179628 A1* 8/2005 Kimura ..... 345/77
2007/0085777 A1* 4/2007 Kuno et al. ..... 345/74.1

FOREIGN PATENT DOCUMENTS

JP 2009-244654 A 10/2009

* cited by examiner

*Primary Examiner* — Lixi C Simpson
(74) *Attorney, Agent, or Firm* — Holtz Holtz Goodman & Chick PC

(57) ABSTRACT

The light emitting device comprises at least one data line, at least one pixel, a common electrode, a data driver and an ammeter, The pixel comprises a pixel drive circuit and a light emitting element, in which the pixel drive circuit includes a first transistor electrically connected to the data line and one end of the light emitting element, and the other end of the light emitting element is connected to the common electrode.

The ammeter measures the current value of a detection current flowing from the data driver to the ammeter via the data line, the first transistor, the light emitting element of the pixel, and the common electrode when the data driver applies to the data line a first set voltage having such a potential that applies a forward bias voltage between both ends of the light emitting element via the first transistor.

21 Claims, 20 Drawing Sheets

Ls1
Vhigh
Vlow
ts

Ls2
Vhigh
Vlow
ts

Ls3
Vhigh
Vlow
ts

Lsn
Vhigh
Vlow
ts

Lv1
Vcc
Vss

Lv2
Vcc
Vss

Lv3
Vcc
Vss

Lvn
Vcc
Vss

FIG. 4A
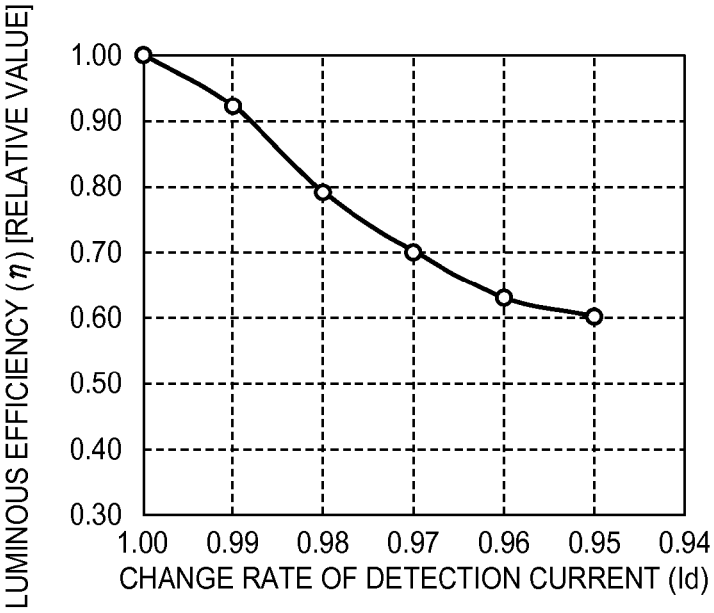
FIG. 4B
| CHANGE RATE OF DETECTION CURRENT (Id) | LUMINOUS EFFICIENCY ( η ) [RELATIVE VALUE] |
|---|---|
| 1.00 | 1.00 |
| 0.99 | 0.92 |
| 0.98 | 0.79 |
| 0.97 | 0.70 |
| 0.96 | 0.63 |
| 0.95 | 0.60 |
FIG. 4C
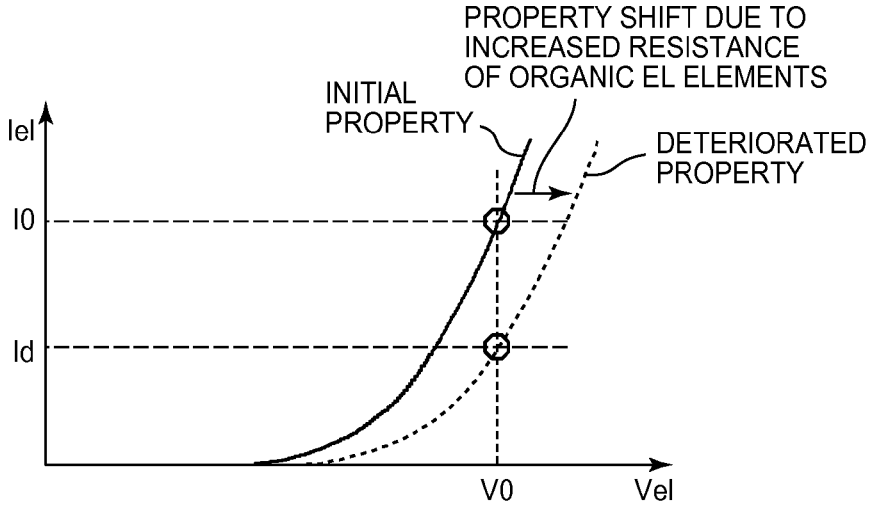

Ls1
Vhigh
Vlow
tm

Ls2
Vhigh
Vlow
tm

Ls3
Vhigh
Vlow
tm

Lsn
Vhigh
Vlow
tm
tm
td
tp

Ld1
Vss
Vd
Vcom

Ld2
Vss
Vd
Vcom
td

Ld3
Vss
Vd
Vcom
td

Ldm
Vss
Vd
Vcom
td

Lv1~Lvn
Vss
Vcom

Ls1
Ls2
Ls3
Lsn
Ld1
Ld2
Ld3
Ldm
Lv1~Lvn
Vhigh
Vlow
Vss
Vd
Vcom
tn
tp

Ls1 - Lsa

Lsa+1 - Lsb

Lsb+1 - Lsn

Ld1 - Ldc

Ldc+1 - Ldd

Ldd+1 - Ldm

Lv1 - Lvn
Vhigh
Vlow
Vss
Vd
Vcom
tq
te
tp

LIGHT EMITTING DEVICE, DRIVE CONTROL METHOD THEREOF, AND ELECTRONIC DEVICE

CROSS-REFERENCE TO RELATED APPLICATION

This application claims the benefit of Japanese Patent Application Nos. 2010-212844, filed on Sep. 22, 2010, and 2010-221480, filed on Sep. 30, 2010, the entire disclosure of which is incorporated by reference herein.

FIELD

This application relates generally to a light emitting device, drive control method thereof and an electronic device, and more particularly, to a light emitting device comprising at its pixels light emitting elements emitting light according to image data and a drive control method thereof, and an electronic device in which the light emitting device is mounted.

BACKGROUND

Light emitting element type displays (light emitting devices) in which light emitting elements, such as organic EL elements, inorganic EL elements, or LEDs, are arranged in a matrix and the light emitting elements emit light for display are known.

The light emitting element type displays have excellent properties such as high luminance, high contrast, high resolution, and low power. Particularly, light emitting element type displays using organic EL elements have been drawing attention.

Among light emitting devices having at their pixels light emitting elements consisting of organic EL elements, some light emitting devices have at their pixels light emitting elements consisting of organic EL elements and drive elements such as thin film transistors for driving the light emitting elements, wherein the voltage applied to the pixels via data lines is controlled so as to control the current flowing through the organic EL elements and achieve light emission with a desired luminance.

Light emitting elements consisting of organic EL elements emit light as a current flows and it is known that they deteriorate in light emission properties over time in the course of light emission; consequently, resistance increases and luminous efficiency drops.

For that reason, when the same voltage is applied, the current flowing through the organic EL elements gradually decreases over time and the luminance drops. Then, after prolonged use of the light emitting device, the luminance for the same applied voltage gradually drops over time. When such a light emitting device is used in a display device, the images displayed according to image data gradually become darker and the display quality progressively drops.

With regard to the above problem, for example, Japanese Patent Application KOKAI Publication No. 2009-244654 describes a compensation circuit compensating change in the current flowing through organic EL elements.

The compensation circuit described in the Japanese Patent Application KOKAI Publication No. 2009-244654 passes a constant current to the light emitting elements, measures the voltage between the terminals of a light emitting element at that time, and corrects the voltage applied to the pixels based on the measured voltage so that the luminance in the initial properties is obtained regardless of deterioration over time.

However, the structure described in the Japanese Patent Application KOKAI Publication No. 2009-244654 requires the driver to have a constant current circuit for passing a constant current to the data lines; the driver is complex in circuit structure and control.

SUMMARY

Advantageously, the present invention can provide a light emitting device, a drive control method thereof having the capability of measuring a current flowing in light emitting elements so as to, for example, detect change in the luminous efficiency of the light emitting elements using a relatively simple structure and compensate reduction in the luminous efficiency due to deterioration over time of the light emitting elements so as to prevent deterioration over time in the luminance, and an electronic device includes the light emitting device.

The light emitting device of the present invention in order to obtain the above advantage comprises:

at least one data line;

at least one pixel connected to the data line;

a common electrode;

a data driver which applies a first voltage to the data line; and an ammeter connected to the common electrode at one end, wherein the pixel comprises a pixel drive circuit and a light emitting element, in which (a) the pixel drive circuit includes a first transistor electrically connected to (i) the data line and (ii) one end of the light emitting element, and (b) the other end of the light emitting element is connected to the common electrode; and the ammeter measures the current value of a detection current flowing from the data driver to the ammeter via the data line, the first transistor, the light emitting element of the pixel, and the common electrode when the data driver applies to the data line a first set voltage having such a potential that applies a forward bias voltage between both ends of the light emitting element via the first transistor as the first voltage.

The electronic device of the present invention in order to obtain the above advantage comprises a display part which includes the above light emitting device.

The drive control method for a light emitting device of the present invention in order to obtain the above advantage, wherein the light emitting device comprises (a) at least one data line, (b) at least one pixel connected to the data line, (c) a common electrode, (d) a data driver applying a first voltage to the data line, and (e) an ammeter connected to the common electrode at one end, wherein the pixel comprises a pixel drive circuit and a light emitting element, in which (a) the pixel drive circuit including a first transistor electrically connected to (i) the data line and (ii) one end of the light emitting element, and (b) the other end of the light emitting element being connected to the common electrode; comprises the steps of:

applying a first set voltage as the first voltage to the data line from the data driver, wherein the first set voltage has such a potential that applies a forward bias voltage between both ends of the light emitting element via the first transistor; and measuring the current value of a detection current flowing from the data driver to the ammeter via the data line, pixel drive circuit and light emitting element of the pixel, and common electrode by the ammeter.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE DRAWINGS

A more complete understanding of this application can be obtained when the following detailed description is considered in conjunction with the following drawings, in which:

FIG. 4A is a graphical representation showing an exemplary relationship between the detection current change rate and luminous efficiency for explaining the configuration of the luminous efficiency acquisition part;

FIG. 4B is a table showing an exemplary relationship between the detection current change rate and luminous efficiency for explaining the configuration of the luminous efficiency acquisition part;

FIG. 4C is a graphical representation showing an exemplary relationship between the voltage and current of an organic EL element for explaining the configuration of the luminous efficiency acquisition part;

DETAILED DESCRIPTION

Embodiments of the present invention will be described hereafter with reference to the drawings. The embodiments below refer to various limitations technically preferable for implementing the present invention; however, those limitations do not confine the scope of the invention to the embodiments and illustrations given below.

In the embodiments below, the light emitting device is a display device in which pixels are two-dimensionally arranged. However, the present invention is not confined thereto.

Embodiment 1

First, the display device (light emitting device) according to Embodiment 1 of the present invention will be described.

Figure 1:
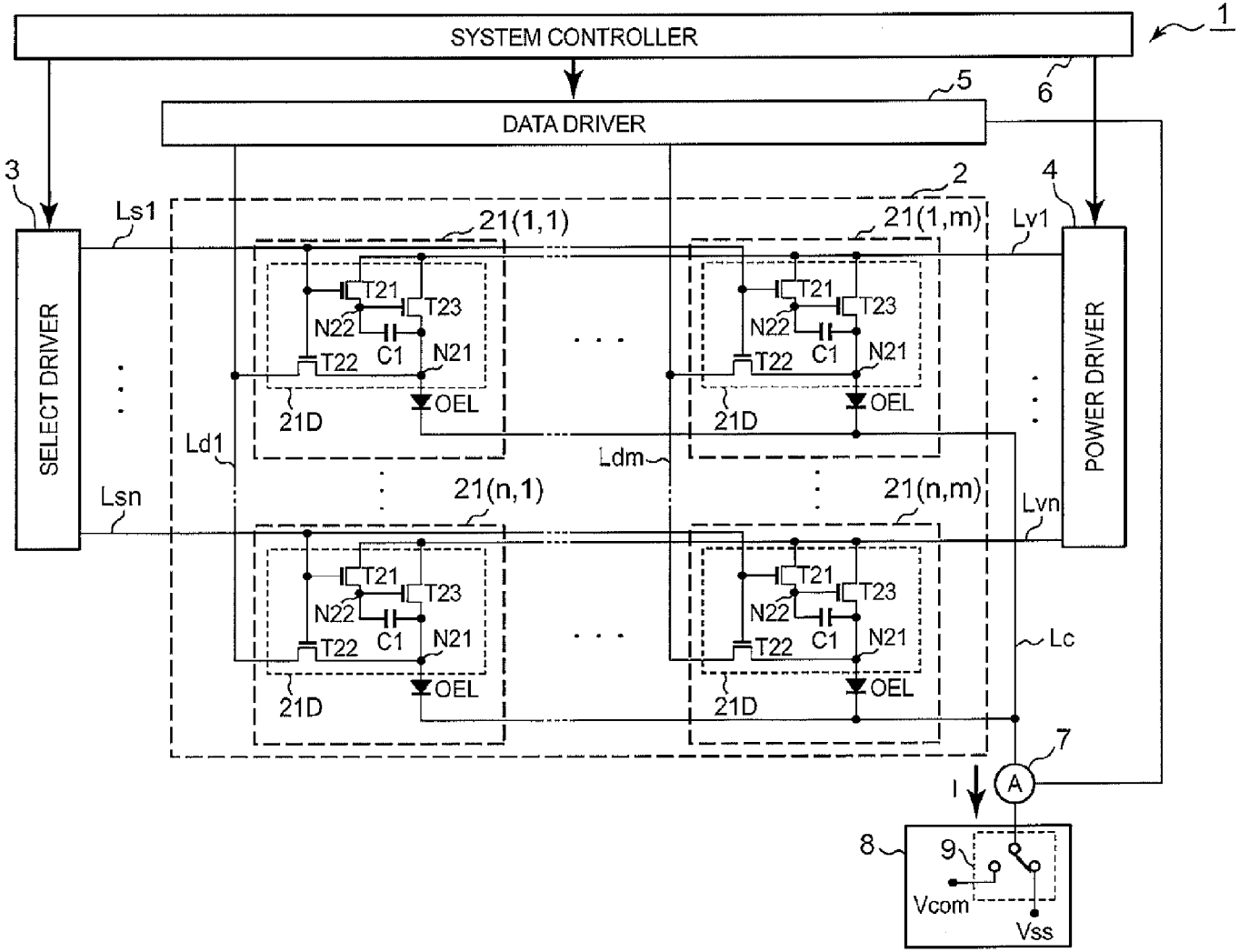
FIG. 1 is an illustration showing an exemplary configuration of the display device according to Embodiment 1 of the present invention.

FIG. 1 is an illustration showing an exemplary configuration of the display device according to Embodiment 1 of the present invention.

As shown in FIG. 1, a display device 1 has a display panel 2, a select driver 3, a power driver 4, a data driver 5, a system controller 6, an ammeter 7, and a cathode circuit 8.

The display panel 2 has multiple, n×m, pixels 21 (21 (1,1) to 21 (n,m)) arranged in a matrix of n rows and m columns, multiple select lines (selection lines) Ls1 to Lsn and power lines Lv1 to Lvn extending in the row direction (the horizontal direction in FIG. 1) and provided at given intervals in the column direction, and multiple data lines Ld1 to Ldm extending in the column direction (the vertical direction in FIG. 1) and provided at given intervals in the row direction. Provided that a row of m pixels of the display panel 2 constitutes a pixel row, the display panel 2 has n pixel rows and a select line Lsi and a power line Lvi are arranged corresponding to a pixel row i.

A pixel 21 (i,j) (i=1 to n, j=1 to m) is placed near the intersection between a select line Lsi and a data line Ldj and connected to the select line Lsi and power line Lvi of the row i and to the data line Ldj of the column j.

A pixel 21 (i,j) is composed of a pixel drive circuit 21D and an organic EL element OEL.

The pixel drive circuit 21D of a pixel 21 (i,j) includes transistors T21 to T23 and a capacitor C1.

The transistors T21 to T23 are n-channel type TFTs (thin film transistors) using amorphous silicon or polysilicon.

The transistor T21 has a gate connected to a select line Lsi, a drain connected to a node N22, and a source connected to a power line Lvi and the source of the transistor T23.

The transistor T22 has a gate connected to a select line Lsi, a source connected to a data line Ldj, and a drain connected to a node N21.

The transistor T23 has a gate connected to the node N22, a drain connected to the node N21, and a source connected to a power line Lvi and the source of the transistor T21. Here, the source of the transistor T21 and the source of the transistor T23 that are connected to a power line Lvj correspond to the power terminals of the present invention.

The capacitor C1 is connected between the nodes N22 and N21, namely between the gate and drain of the transistor T23.

The organic EL element OEL comprises a anode electrode, a cathode electrode, and an electron injection layer, a light emission layer, and a hole injection layer between the electrodes. The anode electrode of an organic EL element OEL is connected to the node N21 and the cathode electrode of the organic EL element OEL is connected to a common cathode electrode Lc. Then, the common cathode electrode Lc is connected to one end of the ammeter 7. The cathode electrodes of the organic EL elements OEL of all pixels 21 are equally connected to the common cathode electrode Lc.

When a current flows from the anode electrode to the cathode electrode, holes supplied from the hole injection layer and electrons supplied from the electron injection layer are recoupled in the light emission layer, and energy generated by the recoupling causes an organic EL element OEL to emit light.

FIG. 2A to 2H are charts showing exemplary scan signals sequentially output to the select lines and voltages sequentially output to the power lines in Embodiment 1 of the present invention.

The select driver 3 is a circuit selecting a row in which multiple pixels 21 are arranged (a pixel row, hereafter) of the display panel 2 and placing each of the pixels 21 of the selected row in a selected state. During the display operation (light emission operation) and during the luminous efficiency acquisition operation described later, the select driver 3 sequentially outputs such scan signals that they have a high level voltage Vhigh (selected level) of a high potential in a selected time period ts and they have a low level voltage Vlow (non-selected level) of a low potential in all other time periods (non-selected time period; light emission time period) to the select lines Ls1 to Lsn as shown in FIG. 2A to 2D.

During the display operation (light emission operation), the power driver 4 shown in FIG. 1 sequentially outputs a reference voltage Vss (for example, a ground potential GND=0 V) to the power lines Lv1 to Lvn corresponding to the pixel row to which a scan signal of a high level voltage Vhigh is applied in each selected time period ts and outputs a power voltage Vcc higher in potential than the reference voltage Vss in all other time periods as shown in FIG. 2E to 2H. In other words, as shown in FIG. 2A to 2H, when a scan signal of a high level voltage Vhigh is applied to a select line Lsi, the power driver 4 outputs the reference voltage Vss to the power line Lvi in the selected time period ts and outputs the power voltage Vcc in all other time periods.

The power driver 4 has the capability of applying a common voltage Vcom (for example, −10 V) to all power lines Lv1 to Lvn during the luminous efficiency acquisition operation described later. The reference voltage Vss, power voltage Vcc, and common voltage Vcom correspond to the drive voltages of the present invention.

The ammeter 7 is connected to the common cathode electrode Lc at one end (the current inlet end) and to the cathode circuit 8 at the other end (the current outlet end), and measures the current value of a current I (which corresponds to a detection current Id described later) flowing through the common cathode electrode Lc.

The cathode circuit 8 is connected to the other end (the current outlet end) of the ammeter 7 at one end and comprises a switch 9 shifting the connection of the one end between to the reference voltage Vss (for example, a ground voltage GND=0 V) and to the common voltage Vcom (for example, −10 V). The cathode circuit 8 applies the reference voltage Vss or the common voltage Vcom to the other end of the ammeter 7 according to shifting of the switch 9.

The system controller 6 supplies control signals to the select driver 3, power driver 4, data driver 5, and cathode circuit 8 to control the select driver 3, power driver 4, data driver 5, and cathode circuit 8 so as to control the entire display device 1.

Figure 3:
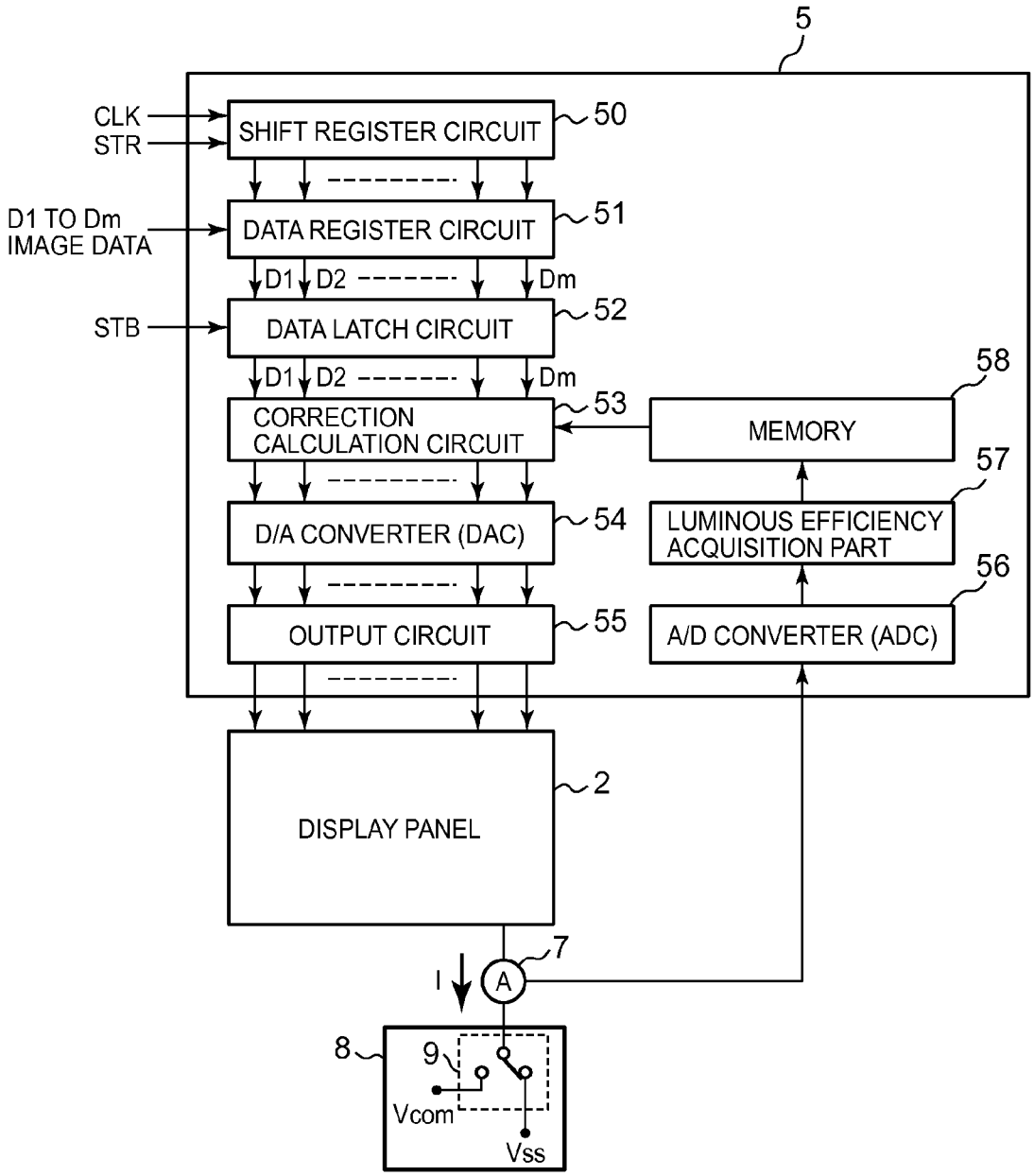
FIG. 3 is an illustration showing an exemplary configuration of the data driver in Embodiment 1 of the present invention.

FIG. 3 is an illustration showing an exemplary configuration of the data driver in Embodiment 1 of the present invention.

The data driver 5 shown in FIG. 1 applies signal voltages corresponding to the luminous gradation of pixels of image data to the data lines Ld1 to Ldm during the display operation described later.

The data driver 5 applies a set voltage Vd (for example, −3 V) or a common voltage Vcom (for example, −10 V) to the data lines Ld1 to Ldm during the luminous efficiency acquisition operation described later.

More specifically, the data driver 5 has, as shown in FIG. 3, a shift register circuit 50, a data register circuit 51, a data latch circuit 52, a correction calculation circuit 53, a digital voltage/analog voltage conversion circuit (DAC) 54, an output circuit 55, an analog voltage/digital voltage conversion circuit (ADC) 56, a luminous efficiency acquisition part 57, and a memory 58.

The shift register circuit 50 sequentially shifts a sampling start signal STR based on a shift clock signal CLK and supplies shift signals to the data register circuit 51 during the display operation.

The data register circuit 51 sequentially retrieves image data D1 to Dm indicating the luminous gradation of pixels in time with the shift signals supplied from the shift register circuit 50. Here, the image data are 8-bit digital signals by way of example. In such a case, light emitted from the organic EL elements OEL has 256 gradation levels.

Supplied with a data latch signal STB, the data latch circuit 52 latches and holds the image data D1 to Dm for one line that are retrieved in the data register circuit 51.

The correction calculation circuit 53 first receives the image data D1 to Dm held in the data latch circuit 52 and converts the image data to voltage data. The voltage data have values indicating the voltage values to be applied to the data lines Ld1 to Ldm for obtaining the luminance of the organic EL elements OEL corresponding to the luminous gradation levels of the image data when the organic EL elements OEL have initial properties.

Then, the correction calculation circuit 53 corrects the voltage data using luminous efficiency η stored in the memory 58 so that the organic EL elements OEL having deteriorated over time emit light with luminance equal to their initial properties before they have deteriorated over time in accordance with the luminous gradation of image data, and create corrected voltage data. Details of the correction will be described later.

The DAC 54 converts the corrected voltage data created by the correction calculation circuit 53 to signal voltages.

The output circuit 55 has a buffer circuit and applies voltages equal in voltage value to the signal voltages supplied from the DAC 54 to the data lines Ld1 to Ldm during the display operation.

On the other hand, the output circuit 55 applies a set voltage Vd (for example, −3 V) or a common voltage Vcom (for example, −10 V) to the first column of data lines Ld1 to Ldm during the luminous efficiency acquisition operation described later.

The ADC 56 converts the current value of a current I measured by the ammeter 7 to a digital signal and supplies it to the luminous efficiency acquisition part 57 during the luminous efficiency acquisition operation described later.

FIGS. 4A, 4B, and 4C are illustrations for explaining the configuration of the luminous efficiency acquisition part. FIG. 4A is a graphical representation showing an exemplary relationship between the detection current change rate and luminous efficiency, FIG. 4B is a table showing an exemplary relationship between the detection current change rate and luminous efficiency, and FIG. 4C is a graphical representation showing an exemplary relationship between the voltage and current of an organic EL element.

Here, the current flowing from the organic EL element OEL of at least one pixel 21 to the common cathode electrode Lc and measured by the ammeter 7 is referred to as a detection current Id.

The luminous efficiency acquisition part 57 comprises a LUT (look-up table) indicating the relationship between the current value change rate of the detection current Id flowing through an organic EL element OEL and the luminous efficiency η as shown in FIG. 4B by way of example.

The change rate of the current value of the detection current Id is calculated by a detection current Id/an initial current I0. The initial current I0 is the current which flows through an organic EL element OEL when a given voltage V0 is applied to the organic EL element OEL having initial properties as shown in FIG. 4C. The detection current Id is the current which is measured by the ammeter 7 when the given voltage V0 is applied to the organic EL element OEL having deteriorated properties including increased resistance and reduced luminous efficiency in comparison to the initial properties.

Here, for example, it is possible to measure the initial current I0 upon factory shipment of the display panel 2 manufactured and store the current value in the luminous efficiency acquisition part 57. Alternatively, it is possible to store a predetermined value of the initial current I0 based on the designed value of the display panel 2 in the luminous efficiency acquisition part 57.

The luminous efficiency η is calculated by L1/L2. The L1 is the luminance of an organic EL element OEL when a drive current having a predetermined given current value flows through the organic EL element OEL having deteriorated over time. The L2 is the luminance of an initial-state organic EL element OEL when a drive current having the same given current value flows through the initial-state organic EL element OEL having initial properties. In other words, the luminous efficiency η is a relative value of the luminance of an organic EL element OEL upon application of a drive current having a given current value with respect to the luminance in the initial state.

The luminous efficiency η gradually drops as the organic EL element OEL deteriorates over time. On the other hand, the current value of a detection current Id when a voltage V0 is applied to an organic EL element OEL gradually decreases because of increased resistance due to deterioration over time. Change in the luminous efficiency η and change in the detection current Id have a correlative relationship and the luminous efficiency η drops as the current value of the detection current Id decreases, for example, as shown in FIG. 4A. In FIG. 4A, the change rate of the current value of the detection current Id is plotted as abscissa. In other words, by increasing the current value of the current flowing through an organic EL element OEL having deteriorated over time by a factor of 1/η, the luminance of the organic EL element OEL can be equal to the luminance in the initial state.

The luminous efficiency acquisition part 57 makes reference to the LUT to acquire the luminous efficiency η corresponding to the detection current Id supplied from the ADC 56.

The memory 58 stores the luminous efficiency η acquired by the luminous efficiency acquisition part 57.

Operation of the display device according to Embodiment 1 of the present invention will be described hereafter.

Operation of the display device includes (i) luminous efficiency acquisition operation performed at given times such as upon power-on to acquire the luminous efficiency η, and (ii) display operation to display images with correction using the acquired luminous efficiency η.

First, the luminous efficiency acquisition operation of the display device according to Embodiment 1 will be described.

FIG. 5A to 5I are charts showing exemplary scan signals, voltages output to the data lines, and voltages applied to the power lines in the luminous efficiency acquisition operation of the display device of Embodiment 1 of the present invention.

Figure 6:
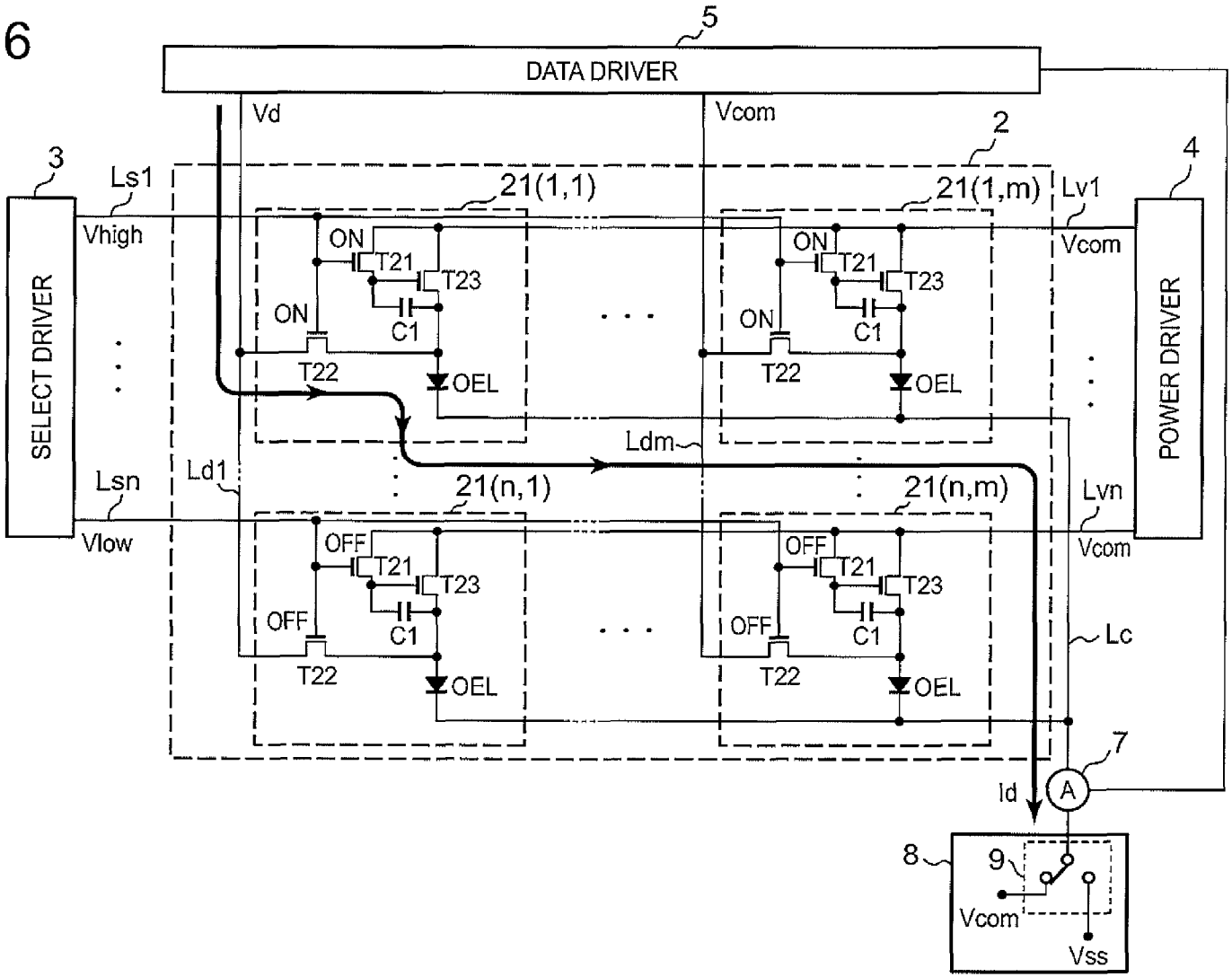
FIG. 6 is an illustration showing an exemplary luminous efficiency acquisition operation in the display device of Embodiment 1 of the present invention.
Figures 7A, 7B, 7C, 7D, 7E, 7F, 7G, 7H, 7I:
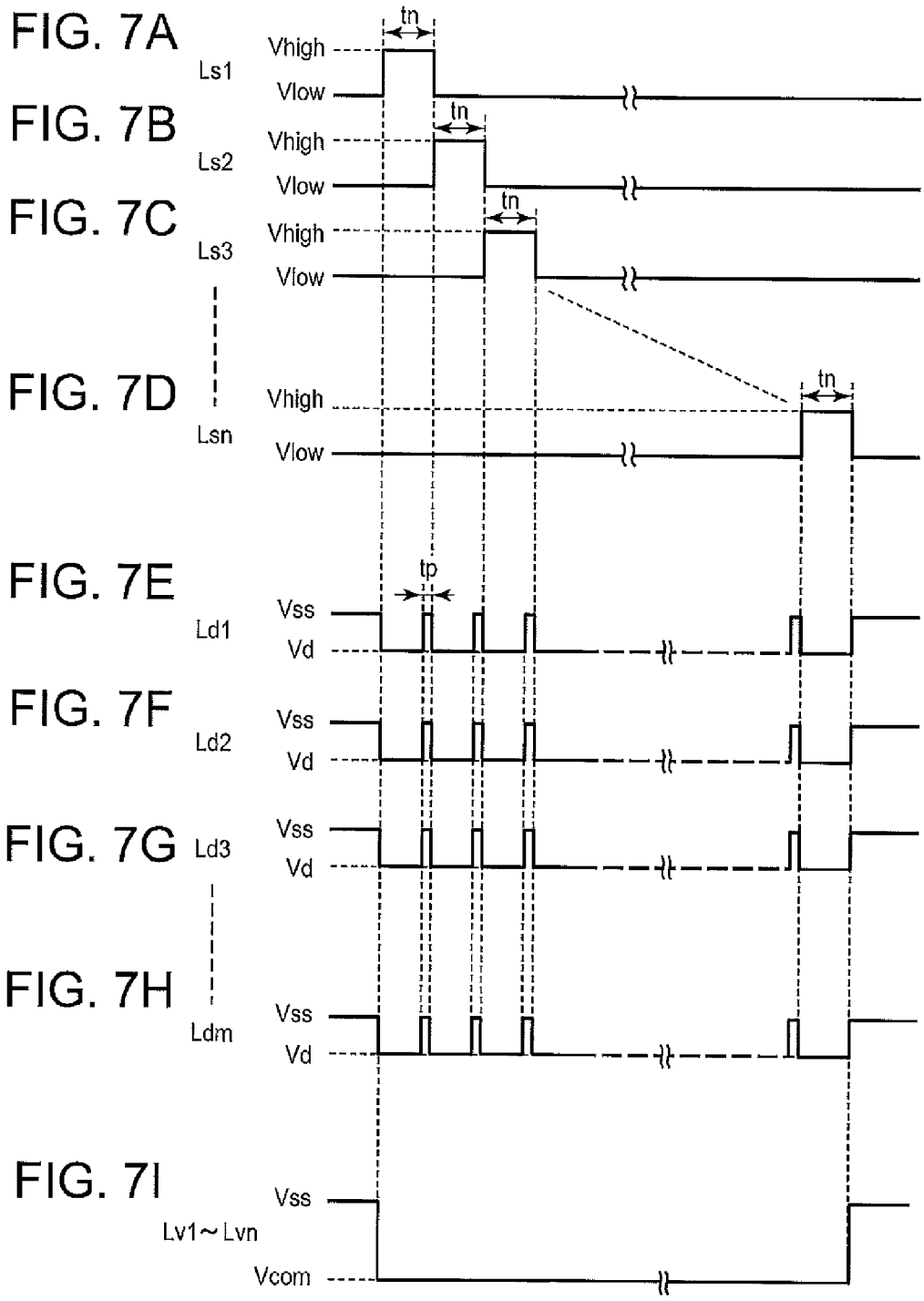
FIG. 7A to 7I are charts showing exemplary scan signals, voltages output to the data lines, and voltages applied to the power lines in the luminous efficiency acquisition operation of the display device of Embodiment 2 of the present invention.

FIG. 6 is an illustration showing an exemplary luminous efficiency acquisition operation in the display device of Embodiment 1 of the present invention.

This luminous efficiency acquisition operation is performed to acquire the luminous efficiency η used for compensating deterioration in display due to deterioration over time of the organic EL elements OEL.

For example, after an initializing process upon power-on is completed, the system controller 6 supplies control signals to the select driver 3, power driver 4, data driver 5, and cathode circuit 8 to instruct them to start the luminous efficiency acquisition operation.

According to the above control, the select driver 3 sequentially outputs such scan signals to the select lines Ls1 to Lsn that they have a high level voltage Vhigh (selected level) of a high potential in a first measuring time period tm and they have a low level voltage Vlow (non-selected level) of a low potential in all other time periods as shown in FIG. 5A to 5D in the same manner as shown in FIG. 2A to 2D. Here, the first measuring time period tm is the time necessary for the ammeter 7 to measure the detection current (the first detection current) Id of a row of m pixels 21 (1,1) to 21 (1,m) as described later.

Figures 5A, 5B, 5C, 5D, 5E, 5F, 5G, 5H, 5I:
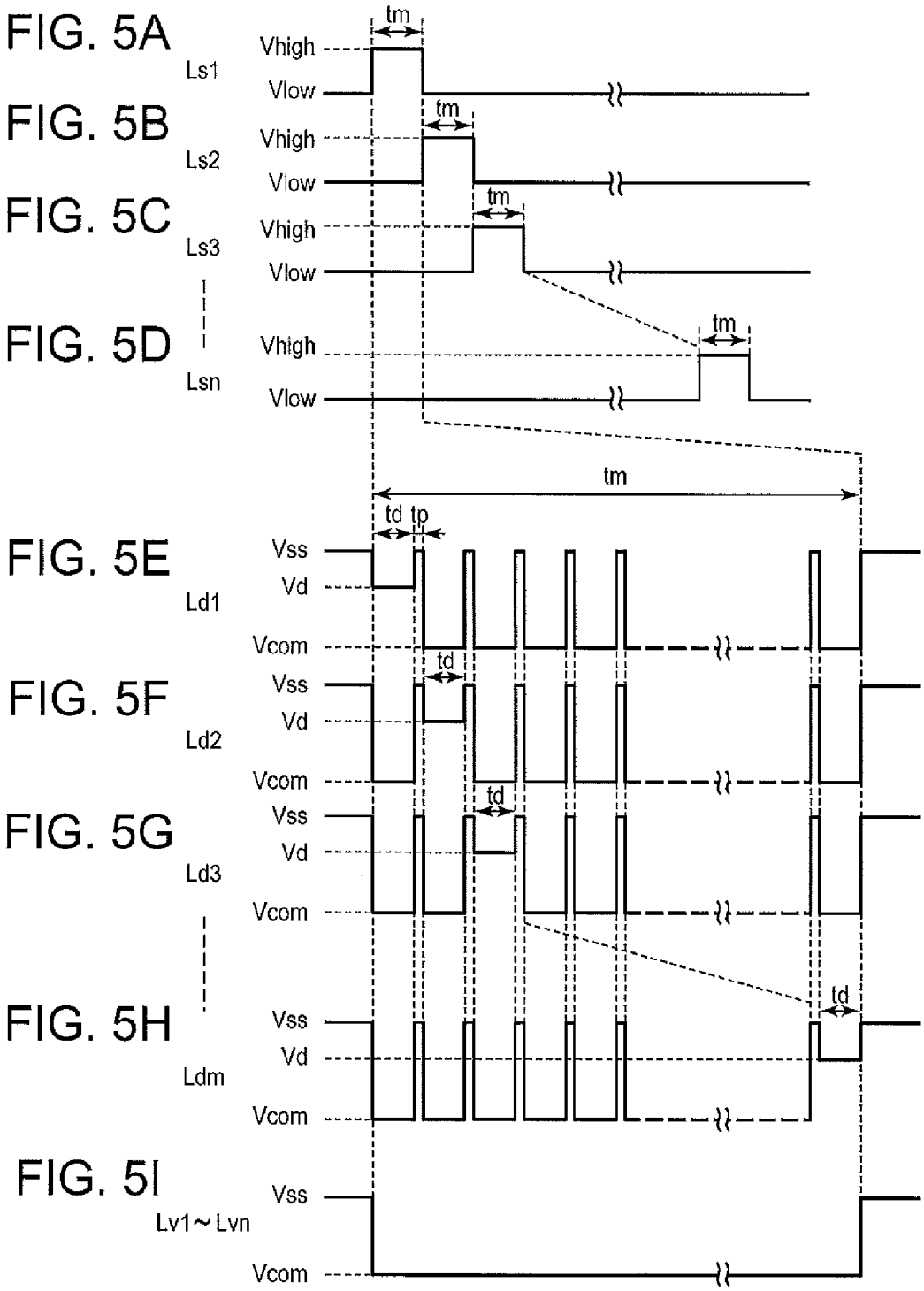
FIG. 5A to 5I are charts showing exemplary scan signals, voltages output to the data lines, and voltages applied to the power lines in the luminous efficiency acquisition operation of the display device of Embodiment 1 of the present invention.

The power driver 4 applies a common voltage Vcom (for example, −10 V) to all power lines Lv1 to Lvn as shown in FIG. 5I.

The data driver 5 sequentially outputs such voltages to the data lines Ld1 to Ldm during the first measuring time period tm that they have a set voltage Vd (for example, −3 V) in a first voltage application time period td, have a common voltage Vcom (for example, −10 V) in other time periods except for intermission time periods tp, and have, for example, a reference voltage Vss in the intermission time periods tp as shown in FIG. 5E to 5H. Here, the first voltage application time period td is set to the time necessary for the ammeter 7 to measure the detection current (the first detection current) Id of a pixel 21.

The cathode circuit 8 shifts the switch 9 to apply a common voltage Vcom (for example, −10 V) to the other end of the ammeter 7.

The luminous efficiency acquisition operation to acquire the luminous efficiency η (1,1) of the organic EL element OEL of a pixel 21 (1,1) in Embodiment 1 will be described hereafter with reference to FIG. 6.

FIG. 6 shows the operation to measure the detection current Id of a pixel 21 (1,1) of the row 1 and column 1.

Here, the select driver 3 applies a scan signal of a high level voltage Vhigh to the select line Ls1 of the row 1 and scan signals of a low level voltage Vlow to the other select lines Ls2 to Lsn.

The data driver 5 applies a set voltage Vd of −3 V to the data line Ld1 of the column 1 and a common voltage Vcom of −10 V to the other data lines Ld2 to Ldm Consequently, as shown in FIG. 6, the transistor T22 of the pixel 21 (1,1) of the row 1 and column 1 is turned on. Then, since −3 V is applied to the data line Ld1 of the column 1 and −10 V is applied to the cathode circuit 8, a voltage of approximately 7 V (test voltage) is applied between the anode and cathode of the organic EL element OEL and a detection current Id flows through a series circuit consisting of the transistor T22 and organic EL element OEL.

On the other hand, the transistors T22 of the pixels 21 of the columns 2 to m in the row 1 are also turned on. However, a voltage applied to the data lines Ld2 to Ldm is a common voltage Vcom (−10 V), which is equal in potential to the other end of the ammeter 7 to which the common voltage Vcom is applied by the cathode circuit 8; therefore, no current flows through a series circuit consisting of the transistor T22 and organic EL element OEL.

In the above, both the data voltage and the other end of the ammeter 7 are set to a common voltage Vcom and are equal in potential. They are not necessarily equal in potential. Basically, what is required is that no current flows through the organic EL element OEL from the transistor T22. It is sufficient that the potential difference between the data voltage and the other end of the ammeter 7 is smaller than a threshold voltage at which a current starts to flow through at least the organic EL element OEL. This applies to the embodiments below.

Furthermore, the transistors T21 of all pixels 21 in the row 1 are turned on. However, no current flows through the transistor T23 because both the source and drain of the transistor T23 have a common voltage Vcom (−10 V) and are equal in potential.

In the above, both the power lines Lv1 to Lvn and the other end of the ammeter 7 are set to a common voltage Vcom and are equal in potential. They are not necessarily equal in potential. Basically, what is required is that no current flows through the organic EL element OEL from the transistor T23. It is sufficient that the potential difference between the power lines Lv1 to Lvn and the other end of the ammeter 7 is smaller than a threshold voltage at which a current starts to flow through at least the organic EL element OEL. This applies to the embodiments below.

Furthermore, the transistors T21, T22, and T23 of the pixels 21 in the rows 2 to n are turned off. Therefore, no current flows through the organic EL elements OEL.

Consequently, the detection current Id flowing through the ammeter 7 is composed of only the current flowing through a series circuit consisting of the transistor T22 and organic EL element OEL of a pixel 21 (1,1) of the row 1 and column 1.

The current value of the detection current Id is measured by the ammeter 7 and the measured value is supplied to the ADC 56.

The ADC 56 converts the current value of the detection current Id to digital data and supplies it to the luminous efficiency acquisition part 57.

The luminous efficiency acquisition part 57 calculates the change rate of the current value of the supplied detection current Id with respect to the initial current I0. Then, the luminous efficiency acquisition part 57 makes reference to the look-up table using the change rate and acquires the corresponding luminous efficiency η.

In this embodiment, the look-up table stores the values of luminous efficiency η corresponding to the values of the change rates of the current values of the detection current Id with respect to the initial current I0 provided that the initial current I0 is the current flowing through a series circuit consisting of an initial-state organic EL element OEL and transistor T22 upon application of a voltage of 7 V.

The luminous efficiency η (1,1) of the organic EL element OEL of the pixel 21 (1,1) acquired by the luminous efficiency acquisition part 57 is stored in the memory 58 in association with the pixel 21 (1,1).

The display device 1 of Embodiment 1 repeats the above operation on a pixel 21 (1,1) for all pixels 21 (i,j) (i=1 to n, j=1 to m) of the display panel 2, acquires the luminous efficiency η (1,1) to η (n,m) of the organic EL elements OEL of all pixels 21 (1,1) to 21 (n,m), and stores the luminous efficiency η (1,1) to η (n,m) in the memory 58 in association with the pixels 21 (1,1) to 21 (n,m).

In other words, first, as shown in FIG. 5A, the select driver 3 applies a scan signal of a high level voltage Vhigh to the select line Ls1 of the row 1 and scan signals of a low voltage Vlow to the other select lines Ls2 to Lsn in the first measuring time period tm.

Then, as shown in FIG. 5E to 5H, the data driver 5 sequentially applies a set voltage Vd (−3 V) to the data lines Ld1 to Ldm in each first voltage application time period td during the first measuring time period tm.

Consequently, in the same manner as in the above luminous efficiency acquisition operation on a pixel 21, the luminous efficiency η (1,1) to η (1,m) of the organic EL elements OEL of m pixels 21 (1,1) to 21 (1,m) in the row 1 is acquired and the luminous efficiency η (1,1) to η (1,m) is stored in the memory 58 in association with the pixels 21 (1,1) to 21 (1,m).

Then, as shown in FIG. 5B, the select driver 3 applies a scan signal of a high level voltage Vhigh to the select line Ls2 of the row 2 and scan signals of a low voltage Vlow to the other select lines Ls1 and Ls3 to Lsn in the first measuring time period tm. Then, as shown in FIG. 5E to 5H, the data driver 5 sequentially applies a set voltage Vd (−3 V) to the data lines Ld1 to Ldm in each first voltage application time period td during the first measuring time period tm.

Consequently, the luminous efficiency η (2,1) to η (2,m) of the organic EL elements OEL of m pixels 21 (2,1) to 21 (2,m) in the row 2 is acquired and the luminous efficiency η (2,1) to η (2,m) is stored in the memory 58 in association with the pixels 21 (2,1) to 21 (2,m).

With the above operation being repeated up to the row n, the luminous efficiency η of the organic EL elements OEL of all pixels 21 (1,1) to 21 (n,m) is acquired and the luminous efficiency η (1,1) to η (n,m) is stored in the memory 58 in association with the pixels 21 (1,1) to 21 (n,m).

After the luminous efficiency η (1,1) to η (n,m) of all pixels 21 (1,1) to 21 (n,m) is stored in the memory 58, the system controller 6 ends the luminous efficiency acquisition operation.

The display operation to display images with correction using the acquired luminous efficiency η (1,1) to η (n,m) will be described hereafter.

Here, the luminous efficiency η and voltage data correction amount have the following relationship. When the organic EL element OEL of a pixel 21 of the display device 1 has luminous efficiency η, a current multiplied by 1/η has to be applied to the organic EL element OEL in order for the organic EL element OEL to emit light with luminance equal to the initial state. To do so, the voltage applied to the pixel 21 has to be multiplied by 1/η for correction. The correction calculation circuit 53 corrects the voltage applied to the pixel 21 based on the above relationship.

First, the system controller 6 shifts the switch 9 of the cathode circuit 8 to apply a reference voltage Vss to the other end of the ammeter 7 upon start of the display operation.

Figures 2A, 2B, 2C, 2D, 2E, 2F, 2G, 2H:
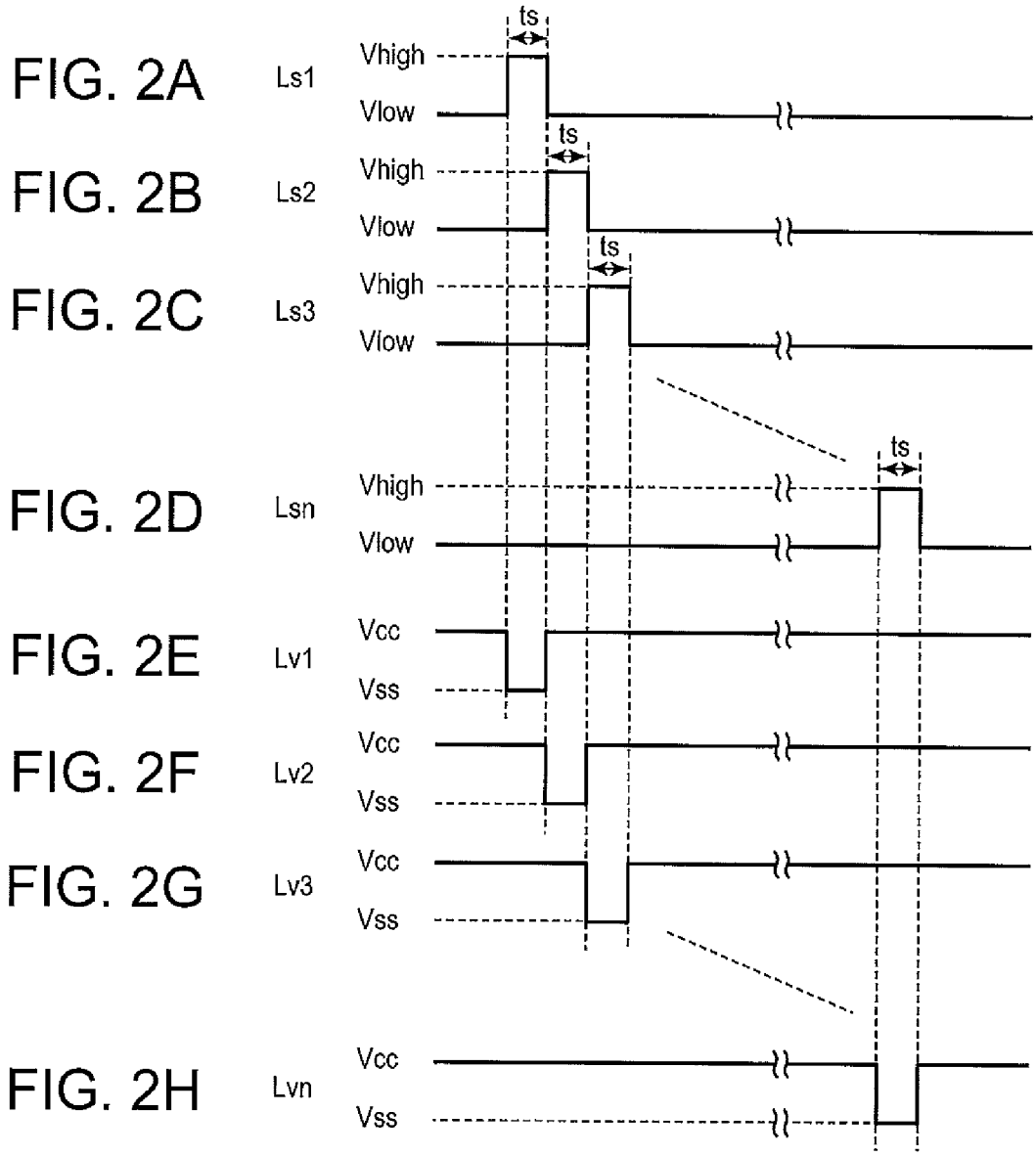
FIG. 2A to 2H are charts showing exemplary scan signals sequentially output to the select lines and voltages sequentially output to the power lines in Embodiment 1 of the present invention.

Subsequently, in response to not-shown vertical synchronizing signals or the like, the system controller 6 outputs control signals to the select driver 3 and power driver 4. In response to the control signals, the select driver 3 outputs a scan signal of a high voltage Vhigh to the select line Ls1 of the row 1 to select the select line Ls1 of the row 1 as shown in FIG. 2A. The power driver 4 outputs a voltage signal of a reference voltage Vss to the power line Lv1 of the row 1 as shown in FIG. 2E.

Furthermore, the system controller 6 outputs control signals to instruct the data driver 5 to perform the display operation.

In response to the control signals, the shift register circuit 50 of the data driver 5 supplies shift signals to the data register circuit 51.

In response to the shift signals supplied from the shift register circuit 50, the data register circuit 51 sequentially retrieves and shifts image data D1 to Dm and, after one-row data for the row 1 are stored, the data latch circuit 52 latches and holds them.

The correction calculation circuit 53 receives the image data D1 to Dm held in the data latch circuit 52 and converts the image data to voltage data set to values corresponding to the initial properties of the organic EL elements OEL. Then, the correction calculation circuit 53 corrects the voltage data to create corrected voltage data having voltage values applied to the data lines Ld1 to Ldm for obtaining the luminance corresponding to the luminous gradation levels of the image data from the organic EL elements OEL having deteriorated over time.

In other words, the correction calculation circuit 53 multiplies each of the voltage data by 1/η (1,j) (j=1 to m) that is a reciprocal of the luminous efficiency η (1,1) to η (1,m) corresponding to the pixels 21 (1,1) to 21 (1,m) stored in the memory 58 to correct the voltage data and create corrected voltage data so that the organic EL elements OEL having deteriorated over time emit light with luminance equal to the initial state.

More specifically, the luminous efficiency η indicates a drop rate, that is caused by deterioration over time, of the luminance of an organic EL element with respect to the initial state when a current having a given current value is applied to the organic EL element. Therefore, in order to obtain luminance equal to the initial state, the current flowing through the organic EL element OEL should have a current value (1/η) times higher than that in the initial state. The voltage applied to the pixel 21 should be (1/η) times higher so that the current flowing through the organic EL element OEL will become (1/η) times larger.

The correction calculation circuit 53 reads the luminous efficiency η (1,j) (j=1 to m) from the memory 58 and multiplies the voltage data by 1/η (1,j) (j=1 to m) to correct the voltage data and create and output corrected voltage data Vdata.

The DAC 54 converts the corrected voltage data Vdata output from the correction calculation circuit 53 to signal voltages (for example, negative gradation voltages −Vdata).

Then, the output circuit 55 outputs the signal voltages (−Vdata) to the data lines Ld1 to Ldm to apply them to the pixels 21 (1,1) to 21 (1,m).

Consequently, a voltage (−Vdata) corresponding to the corrected voltage data multiplied by 1/η (1,j) (j=1 to m) that is a reciprocal of the corresponding luminous efficiency η (1,1) to η (1,m) compared with before the correction is applied to each of the pixels 21 (1,1) to 21 (1,m) and the corresponding voltage is held in the capacitor C1.

Consequently, a current multiplied by approximately 1/η (1,j) (j=1 to m) flows through the organic EL element OEL of each of the pixels 21 (1,1) to 21 (1,m) and the pixels 21 (1,1) to 21 (1,m) conduct display with luminance equal to the initial state.

Then, the select driver 3 selects the select line Ls2 of the row 2. The data register circuit 51 of the data driver 5 sequentially retrieves and shifts image data D1 to Dm and, after one-row data for the row 2 are stored, the data latch circuit 52 latches and holds them.

Subsequently, the correction calculation circuit 53 receives the image data D1 to Dm held in the data latch circuit 52 and converts the image data to voltage data set to values corresponding to the initial properties of the organic EL elements OEL. Then, the correction calculation circuit 53 multiplies each of the voltage data by 1/η (2,j) (j=1 to m) that is a reciprocal of the luminous efficiency η (2,1) to η (2,m) corresponding to each of the pixels 21 (2,1) to 21 (2,m) stored in the memory 58 to correct each of the voltage data and create and output each corrected voltage data.

The DAC 54 converts, for example, the corrected voltage data output from the correction calculation circuit 53 to signal voltages. The output circuit 55 outputs the signal voltages to the data lines Ld1 to Ldm to apply them to the pixels 21 (2,1) to 21 (2,m).

Consequently, the pixels 21 (1,1) to 21 (1,m) conduct display with luminance equal to the initial state.

Then, the above operation is repeated up to the row n so that voltages corresponding to the corrected voltage data are output to the data lines Ld1 to Ldm for all rows and all pixels 21 (1,1) to 21 (n,m) conduct display with luminance equal to the initial state.

As described above, in Embodiment 1, the luminous efficiency acquisition operation is conducted to measure the current value of a current Id flowing through the organic EL element OEL of each pixel upon application of a given voltage V0, obtain the change rate Id/10 with respect to the initial current I0 flowing through the organic EL element OEL having initial properties, and make reference to the look-up table using the change rate to acquire the luminous efficiency η of the organic EL element OEL of each pixel. Then, during the display operation, the voltage data set based on the initial properties of the organic EL elements OEL are respectively multiplied by 1/η (i,j) (i=1 to n, j=1 to m) to correct the voltage data and the corrected voltages corresponding to the corrected voltage data are respectively applied to the pixels 21 (1,1) to 21 (n,m).

Consequently, when the organic EL element OEL has deteriorated over time, the current value of a current flowing through the organic EL element is increased to compensate the drop in luminous efficiency due to deterioration over time for the same image data. In this way, display is conducted with luminance equal to the initial state for the same image data regardless of deterioration over time.

Embodiment 2

Embodiment 2 of the present invention will be described hereafter.

In the above Embodiment 1, the luminous efficiency η of the organic EL element OEL of each of multiple pixels of the display panel is extracted. In such a case, as the number of pixels is increased as in a large panel or in a high resolution panel, the time necessary for the luminous efficiency acquisition operation is increased according to the number of pixels.

On the other hand, in Embodiment 2 below, a measured value collectively obtained for multiple pixels in each row of the display panel is used to acquire the luminous efficiency η of a pixel as the average value per pixel. Consequently, the time necessary for the luminous efficiency acquisition operation on all pixels can be reduced compared with Embodiment 1.

Here, the light emission time of the pixels 21 (1,1) to 21 (n,m) of the display panel 2 generally becomes unequal in the course of use. Therefore, the pixels 21 (1,1) to 21 (n,m) generally do not equally deteriorate over time. However, for example, in the case of displaying moving images such as TV pictures, there is presumably no extreme difference in deterioration over time at least among a row of m pixels 21.

Embodiment 2 is designed to suit for the above case, in which the luminous efficiency $\eta_n$ corresponding to a pixel 21 is acquired as the average value per pixel 21 obtained from a row of m pixels 21 and used to correct the voltage data. Here, the luminous efficiency $\eta_n$ is the average value of luminous efficiency corresponding to a pixel 21 that is obtained from m pixels 21 (n,1) to 21 (n,m) in the row n.

Here, the configuration and operation of the display device according to Embodiment 2 includes the same configuration and operation as those of the display device 1 of the above Embodiment 1. The following explanation will focus on the difference from Embodiment 1 and explanation of the components equivalent to those of Embodiment 1 will be omitted or simplified.

The luminous efficiency acquisition operation of the display device according to Embodiment 2 will be described with reference to the drawings.

FIG. 7A to 7I are charts showing exemplary scan signals, voltages sequentially output to the data lines, and voltages applied to the power lines in the luminous efficiency acquisition operation of the display device of Embodiment 2 of the present invention.

Figure 8:
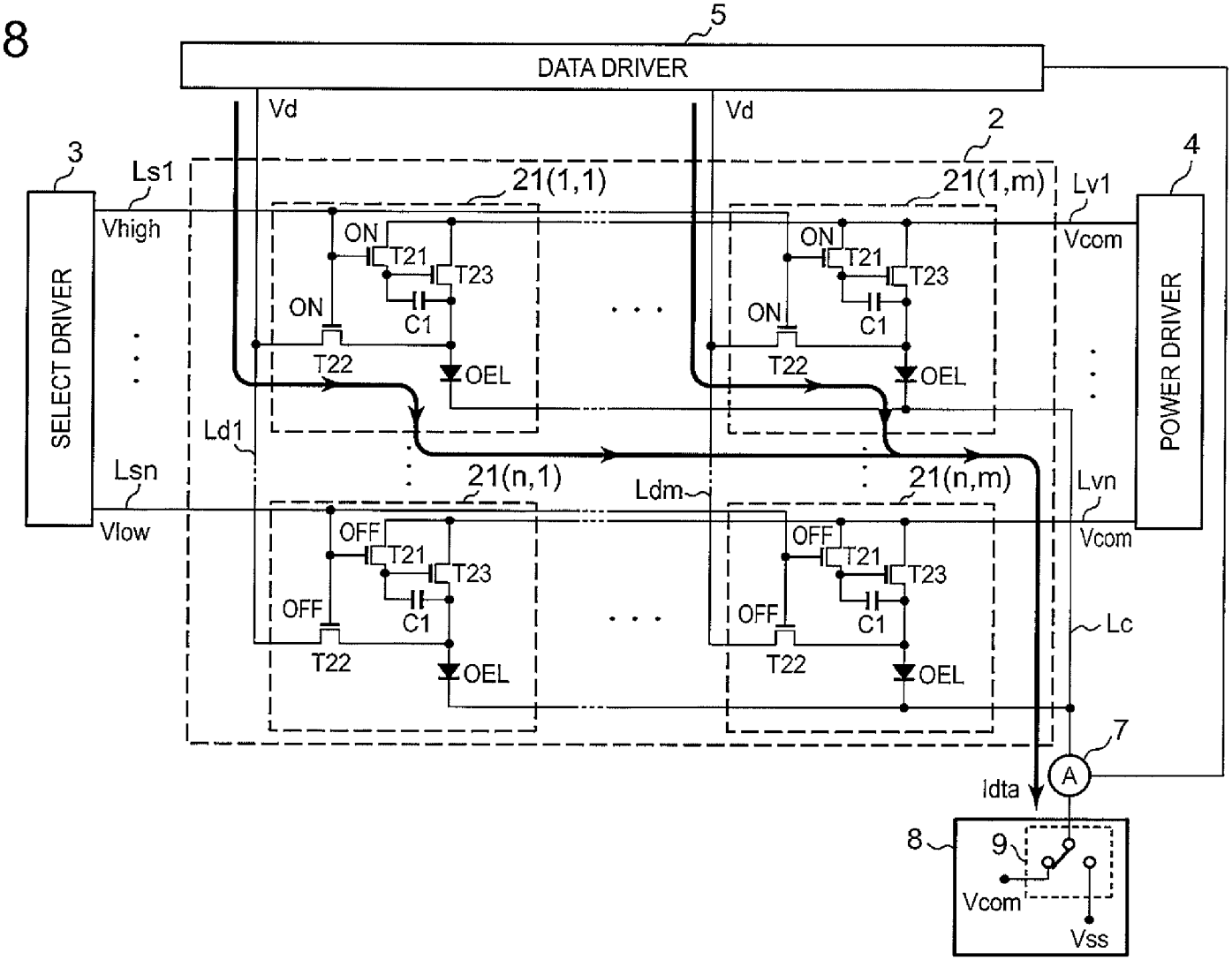
FIG. 8 is an illustration showing an exemplary luminous efficiency acquisition operation in the display device of Embodiment 2 of the present invention.

FIG. 8 is an illustration showing an exemplary luminous efficiency acquisition operation in the display device of Embodiment 2 of the present invention.

In the luminous efficiency acquisition operation of Embodiment 2, the select driver 3 sequentially outputs such scan signals to the select lines Ls1 to Lsn that they have a high level voltage Vhigh (selected level) of a high potential in a second measuring time period to and they have a low level voltage Vlow (non-selected level) of a low potential in all other time periods as shown in FIG. 7A to 7D in the same manner as shown in FIG. 2A to 2D.

Here, the second measuring time period tn is set to the time necessary for the ammeter 7 to measure a first total detection current Idta that is the total of currents flowing through m pixels 21 in a row. The second measuring time period tn is, for example, equal to the first voltage application time period td in the above Embodiment 1.

The data driver 5 applies a set voltage Vd of an equal potential (for example, −3 V) to all data lines Ld1 to Ldm in sync with the second measuring time period tn by the select driver 3.

The power driver 4 applies a common voltage Vcom (for example, −10 V) to all power lines Lv1 to Lvn as shown in FIG. 71.

The cathode circuit 8 shifts the switch 9 to apply a common voltage Vcom (for example, −10V) to the other end of the ammeter 7.

The ammeter 7 measures the current value of the first total detection current Idta flowing through the common cathode electrode Lc. The first total detection current Idta is the total of currents flowing through the m pixels 21 (1,1) to 21 (1,m) in the row 1, when a set voltage Vd (for example, −3 V) is applied to all data lines Ld1 to Ldm The luminous efficiency acquisition part 57 divides the current value of the first total detection current Idta by m to acquire a detection current Id as the average value per pixel 21 of the current value of the first total detection current Idta flowing through the m pixels 21.

Then, the luminous efficiency acquisition part 57 calculates the change rate of the current value of the acquired detection current Id with respect to the initial current I0 flowing through the organic EL elements OEL having initial properties, and makes reference to the look-up table using the calculated change rate to acquire the corresponding luminous efficiency η.

The luminous efficiency acquisition operation to acquire the luminous efficiency η of the organic EL element OEL per a pixel 21 as the average value per pixel 21 from m pixels 21 in a row will be described hereafter with reference to the drawings.

FIG. 8 illustrates measurement of the first total detection current Idta of the pixels 21 (1,1) to 21 (1,m) in the row 1.

Here, the select driver 3 applies a scan signal of a high level voltage Vhigh to the select line Ls1 of the row 1 and scan signals of a low level voltage Vlow to the other select lines Ls2 to Lsn.

The power driver 4 applies a common voltage Vcom (for example, −10 V) to all power lines Lv1 to Lvn.

The data driver 5 applies a set voltage Vd (for example, −3 V) to all data lines Ld1 to Ldm The cathode circuit 8 shifts the switch 9 to apply a common voltage Vcom to the other end of the ammeter 7.

Then, as shown in FIG. 8, the transistors T22 of the pixels 21 (1,1) to 21 (1,m) of all columns in the row 1 are turned on.

Then, since −3 V is applied to the data lines Ld1 to Ldm and −10 V is applied to the cathode circuit 8, a voltage of approximately 7 V (test voltage) is applied between the anode and cathode of the organic EL elements OEL of the pixels in the row 1 and a current Id flows through the series circuits each consisting of the transistor 22 and organic EL element OEL of all pixels 21 in the row 1.

On the other hand, the transistors T21, T22, and T23 of the pixels in the other rows are all turned off and, therefore, no current flows.

Consequently, the current flowing through the ammeter 7 is the first total detection current Idta consisting of the total of currents Id flowing through the m pixels 21 (1,1) to 21 (1,m) in the row 1.

The current value of the first total detection current Idta is measured by the ammeter 7 and the measured value is supplied to the ADC 56.

The ADC 56 converts the current value of the first total detection current Idta to digital data and supplies it to the luminous efficiency acquisition part 57.

The luminous efficiency acquisition part 57 divides the current value of the first total detection current Idta by m to acquire a detection current Id for a pixel 21.

Then, the luminous efficiency acquisition part 57 makes reference to the look-up table using the change rate of the current value of the acquired detection current Id with respect to the initial current I0 to acquire the corresponding luminous efficiency $\eta_1$.

The acquired luminous efficiency $\eta_1$ is stored in the memory 58 in association with the row 1.

Then, during the display operation, the voltage data of the pixels 21 (1,1) to 21 (1,m) in the row 1 are corrected using the luminous efficiency $\eta_1$ stored in the memory 58.

The correction calculation circuit 53 receives image data D1 to Dm held in the data latch circuit 52 and converts the image data to voltage data set to values corresponding to the initial properties of the organic EL elements OEL. Then, the correction calculation circuit 53 corrects the voltage data to create corrected voltage data having voltage values applied to the data lines Ld1 to Ldm for obtaining the luminance corresponding to the luminous gradation levels of the image data from the organic EL elements OEL having deteriorated over time.

In order for the organic EL elements OEL having deteriorated over time to emit light with luminance equal to the initial state, the correction calculation circuit 53 multiplies each of the voltage data by $(1/\eta_1)$ that is a reciprocal of the luminous efficiency $\eta_1$ stored in the memory 58 to correct the voltage data and create corrected voltage data.

The DAC 54 converts each of the corrected voltage data output from the correction calculation circuit 53 to a signal voltage.

The output circuit 55 outputs the signal voltages to the data lines Ld1 to Ldm Consequently, data voltages multiplied by $(1/\eta_1)$ compared with before the correction are applied to the pixels 21 (1,1) to 21 (1,m) as in Embodiment 1. Consequently, an approximately $(1/\eta_1)$ times larger current flows through the pixels 21 (1,1) to 21 (1,m) and display (light emission) with luminance equal to the initial state is conducted.

In the luminous efficiency acquisition operation of the display device 1 of Embodiment 2, the above operation on m pixels 21 in a row is sequentially performed for all rows of the display panel 2. In other words, the luminous efficiency $\eta_1$ to $\eta_n$ of the organic EL elements OEL of the pixels in the individual rows is acquired and the luminous efficiency $\eta_1$ to $\eta_n$ is stored in the memory 58 in association with the respective rows.

During the display operation, the correction calculation circuit 53 sequentially receives image data D1 to Dm corresponding to each row of the display panel 2 and converts them to voltage data corresponding to the image data. The correction calculation circuit 53 multiplies each of the voltage data by $1/\eta_i$ (i=1 to n) that is a reciprocal of the luminous efficiency $\eta_i$ (i=1 to n) stored in the memory 58 and associated with the each row to correct each of the voltage data and create each corrected voltage data having a voltage values applied to each of the data lines Ld1 to Ldm for obtaining the luminance corresponding to the luminous gradation levels of the image data. Then, the signal voltages corresponding to the corrected voltage data are output to the data lines Ld1 to Ldm via the DAC 54 and output circuit 55 for all rows, respectively.

Consequently, all pixels 21 (1,1) to 21 (n,m) conduct display with luminance equal to the initial state.

In Embodiment 2, the time necessary for the luminous efficiency acquisition operation is decreased to approximately 1/m of the time necessary for the luminous efficiency acquisition operation in the above Embodiment 1 provided that there are m pixels 21 in a row; the time necessary for the luminous efficiency acquisition operation can be reduced compared with Embodiment 1.

Embodiment 3

Embodiment 3 of the present invention will be described hereafter.

In the above Embodiment 2, the luminous efficiency $\eta$ of a pixel is acquired from multiple pixels in each row.

On the other hand, in Embodiment 3, the display region of the display panel in which multiple pixels are arranged is horizontally and vertically divided into multiple divided regions consisting of given numbers of rows and columns and the luminous efficiency $\eta$ of a pixel is acquired from multiple pixels in a divided region.

In other words, when any image is displayed on the display panel 2, the pixels 21 generally do not equally deteriorate over time. However, for example, assuming figures are displayed nearly in the center of the display region, presumably, the difference in light emission time among the pixels 21 in each of multiple divided regions defined by vertically and horizontally dividing the display region is relatively small. In such a case, the pixels 21 in a divided region presumably deteriorate over time more or less to the same degree.

Embodiment 3 is designed to suit for the above case. The display region of the display panel 2 is divided into multiple divided regions and the luminous efficiency $\eta$ of a pixel 21 is acquired as the average value per pixel 21 obtained from multiple pixels 21 in each of the multiple divided regions.

The luminous efficiency acquisition operation according to Embodiment 3 will be described with reference to the drawings.

Here, the configuration and operation of the display device according to Embodiment 3 includes the same configuration and operation as those of the display device 1 of the above embodiments. The following explanation will focus on the difference from the above embodiments and explanation of the components equivalent to those of the above embodiments will be omitted or simplified.

Figure 9:
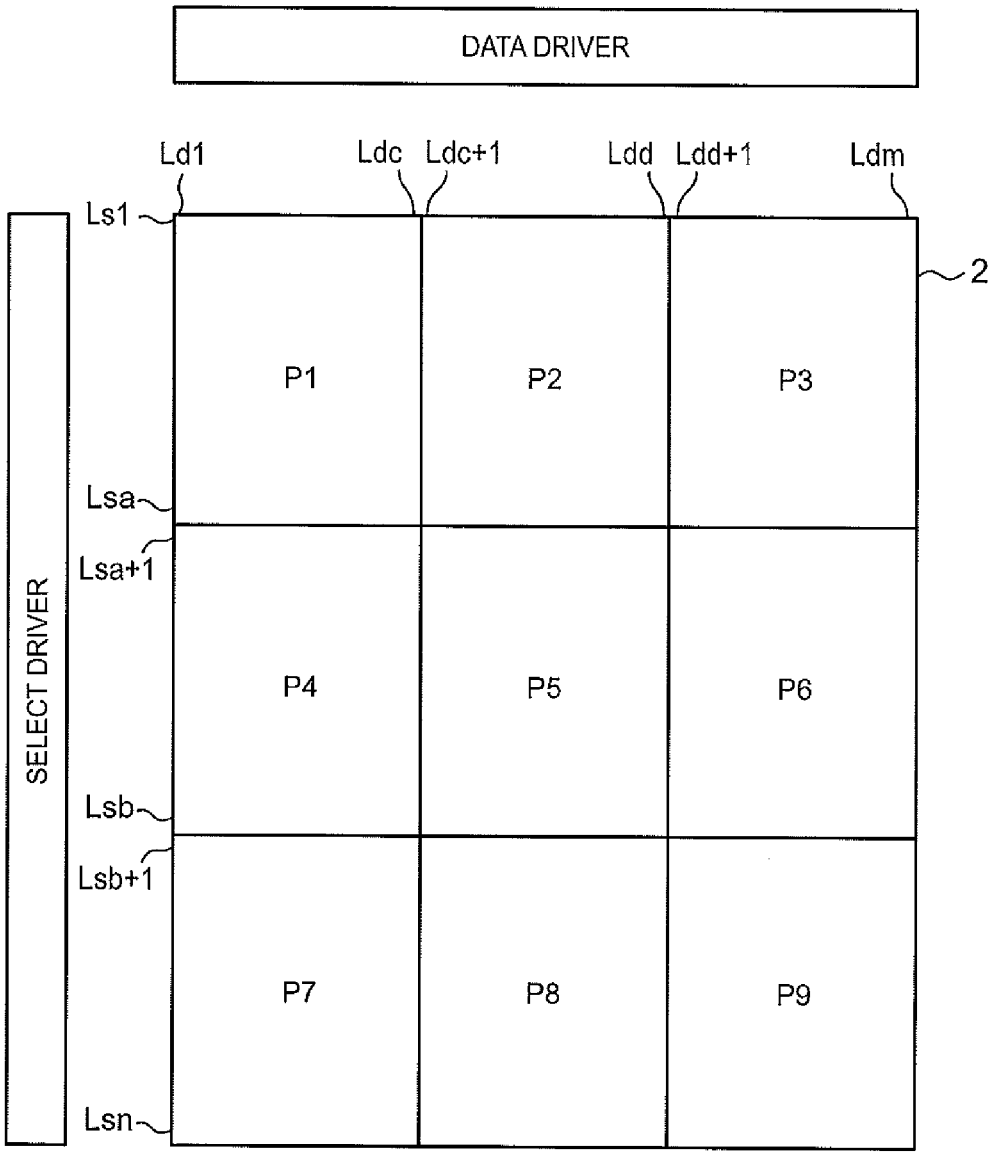
FIG. 9 is an illustration showing exemplary divided regions of the display region of the display device of Embodiment 3 of the present invention.

FIG. 9 is an illustration showing exemplary divided regions of the display region of the display device of Embodiment 3 of the present invention.

FIG. 10A to 10G are charts showing exemplary scan signals, voltages output to the data lines, and voltages applied to the power lines in the luminous efficiency acquisition operation of the display device of Embodiment 3 of the present invention.

In Embodiment 3, as shown in FIG. 9, the display panel 2 is divided into, for example, nine divided regions P1 to P9.

In other words, the select lines Ls1 to Lsn are divided into three groups of a given number of lines, Ls1 to Lsa, Lsa+1 to Lsb, and Lsb+1 to Lsn. The data lines Ld1 to Ldm are divided into three groups, Ld1 to Ldc, Ldc+1 to Ldd, and Ldd+1 to Ldm.

Figures 10A, 10B, 10C, 10D, 10E, 10F, 10G:
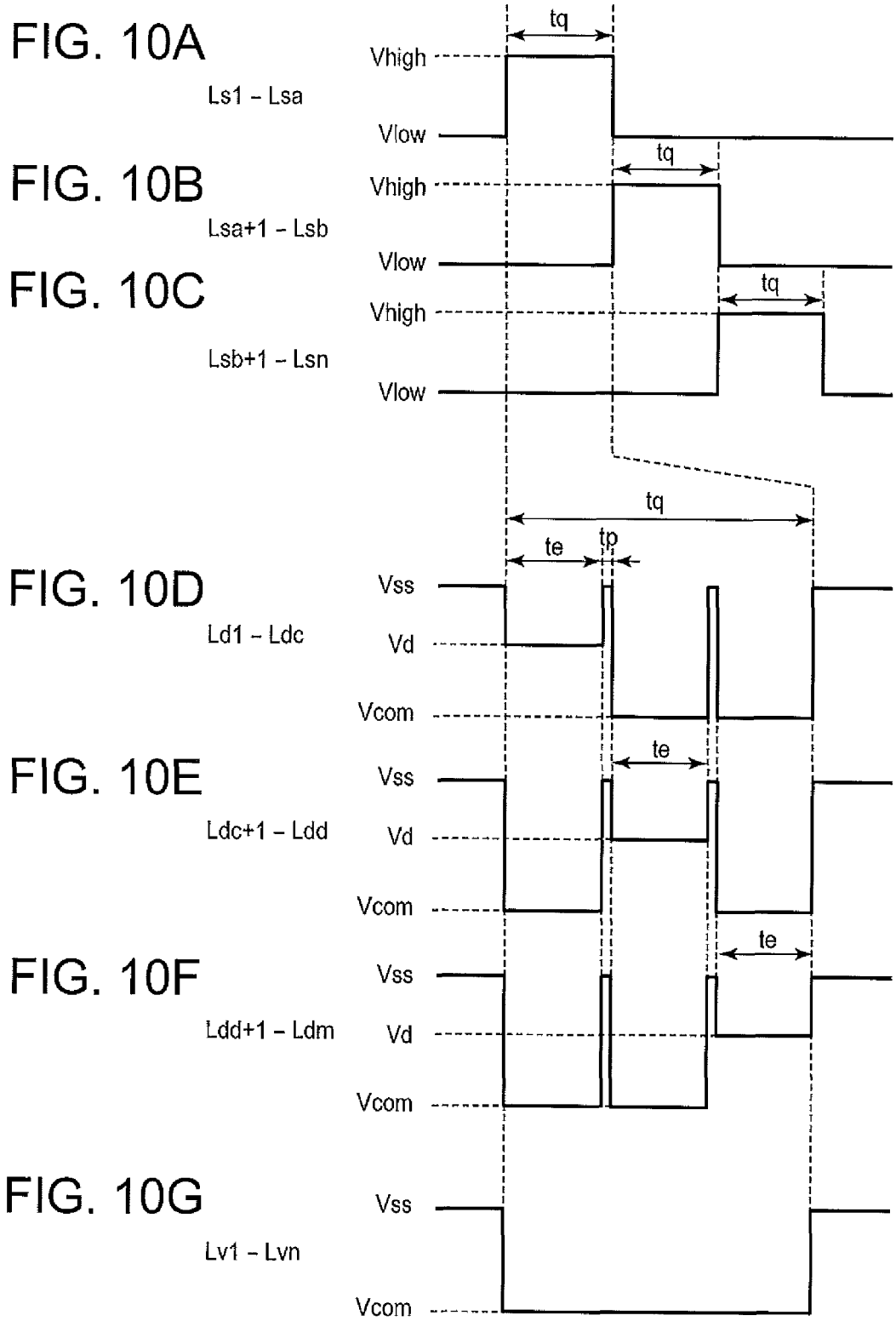
FIG. 10A to 10G are charts showing exemplary scan signals, voltages output to the data lines, and voltages applied to the power lines in the luminous efficiency acquisition operation of the display device of Embodiment 3 of the present invention.

In the luminous efficiency acquisition operation, the select driver 3 sequentially outputs such scan signals to the groups of multiple select lines, Ls1 to Lsa, Lsa+1 to Lsb, and Lsb+1 to Lsn that they have a high level voltage Vhigh (selected level) in a third measuring time period tq and they have a low level voltage Vlow (non-selected level) in all other time periods as shown in FIG. 10A to 10C.

Here, the third measuring time period tq is set to the time necessary for the ammeter 7 to measure a second total detection current Idta for each of multiple, for example three, divided regions arranged in the row direction of the display panel 2.

The data driver 5 sequentially applies such voltages to the data lines Ld1 to Ldc, Ldc+1 to Ldd, and Ldd+1 to Ldm during the third measuring time period tq, that they have a set voltage Vd (for example, −3 V) in a second voltage application time period te, have a common voltage Vcom (for example, −10 V) in the other time periods except for intermission time periods tp, and have, for example, a reference voltage Vss in the intermission time periods tp.

Here, the second voltage application time period te is set to the time necessary for the ammeter 7 to measure a second total detection current Idtb that is the total of currents flowing through multiple pixels 21 in a divided region of the display panel 2. The second voltage application time period te is equal, for example, to the first voltage application time period td in the above embodiment 1.

The power driver 4 applies a common voltage Vcom (for example, −10 V) to all power lines Lv1 to Lvn as shown in FIG. 10G.

The cathode circuit 8 shifts the switch 9 to apply a common voltage Vcom (for example, −10V) to the other end of the ammeter 7.

Consequently, for example, when the select driver 3 simultaneously outputs scan signals of a high level voltage Vhigh to the select lines Ls1 to Lsa to simultaneously select the select lines Ls1 to Lsa, and the data driver 5 outputs a set voltage Vd (−3 V) to the data lines Ld1 to Ldc simultaneously, the transistors T22 of a×c pixels 21 (1,1) to 21 (a,c) in the divided region P1 consisting of the rows 1 to a and columns 1 to c are turned on to apply −3 V to the data lines Ld1 to Lda and apply −10 V to the cathode circuit 8. Consequently, a current Id flows through the series circuits each consisting of the transistor T22 and organic EL element OEL of each of the a×c pixels 21 in the divided region P1.

On the other hand, no current flows through the other pixels.

The ammeter 7 measures the current value of the second total detection current Idtb flowing through the common cathode electrode Lc. The second total detection current Idtb is the total of currents flowing through the transistors T22 and organic EL elements OEL of the a×c pixels 21 (1,1) to 21 (a,c) in the divided region P1 consisting of the rows 1 to a and columns 1 to c.

The ADC 56 converts the current value of the second total detection current Idtb measured by the ammeter 7 to digital data and supplies it to the luminous efficiency acquisition part 57.

The luminous efficiency acquisition part 57 divides the current value of the second total detection current Idtb by (a×c) to acquire a detection current Id as the average value per pixel 21 of the current value of the second total detection current Idtb flowing through the a×c pixels 21 in the divided region P1.

Then, the luminous efficiency acquisition part 57 calculates the change rate of the current value of the acquired detection current Id with respect to the current value of the initial current I0, and makes reference to the look-up table using the change rate to acquire the luminous efficiency $\eta_{P1}$ corresponding to a pixel 21 in the divided region P1.

The acquired luminous efficiency $\eta_{P1}$ is stored in the memory 58 in association with the divided region P1.

The display device 1 of Embodiment 3 performs the above operation on the pixels in a divided region for all divided regions of the display panel 2 in sequence, acquires the luminous efficiency $\eta_{P1}$ to $\eta_{P9}$ of the organic EL elements OEL of the pixels 21 in the individual divided regions and stores it in the memory 58 in association with the respective divided regions P1 to P9.

During the display operation, the voltage data of each of the pixels 21 is corrected using the luminous efficiency $\eta_{P1}$ to $\eta_{P9}$ stored in the memory 58 and associated with the divided regions P1 to P9.

The correction calculation circuit 53 receives image data D1 to Dm held in the data latch circuit 52 and converts the image data to voltage data set to values corresponding to the initial properties of the organic EL elements OEL. Then, the correction calculation circuit 53 corrects each of the voltage data to create corrected voltage data having a voltage value applied to each of the data lines Ld1 to Ldm for obtaining the luminance corresponding to the luminous gradation levels of the image data from the organic EL elements OEL having deteriorated over time.

In order for the organic EL elements OEL having deteriorated over time to emit light with luminance equal to the initial state, the correction calculation circuit 53 multiplies the voltage data by $(1/\eta_{Pn})$ that is a reciprocal of the luminous efficiency $\eta_{Pn}$ stored in the memory 58 and associated with the divided regions to correct the voltage data and create corrected voltage data. Then, the signal voltages corresponding to the corrected voltage data are output to the data lines Ld1 to Ldm for all rows.

In Embodiment 3, the time necessary for the luminous efficiency acquisition operation is approximately lip of the time necessary for the luminous efficiency acquisition operation in the above Embodiment 1 provided that there are p pixels 21 in a divided region; the time necessary for the luminous efficiency acquisition operation can be reduced compared with Embodiment 1.

An exemplary method of the select driver 3 simultaneously outputting scan signals of a high level voltage Vhigh to the respective groups of select lines Ls1 to Lsa, Lsa+1 to Lsb, and Lsb+1 to Lsn will be described hereafter.

The method is not particularly restrictive. However, the following method allows for, for example, the control without changing the configuration of an existing select driver 3.

Figure 11A:
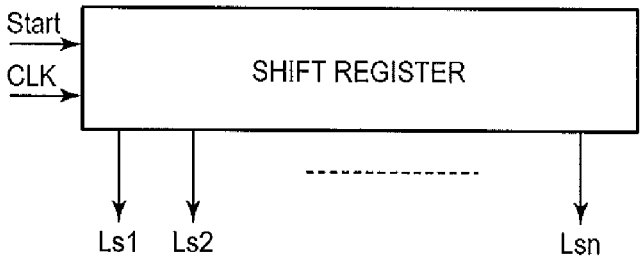
FIG. 11A is an illustration showing an exemplary shift register of the display device of Embodiment 3 of the present invention.
Figure 11B:
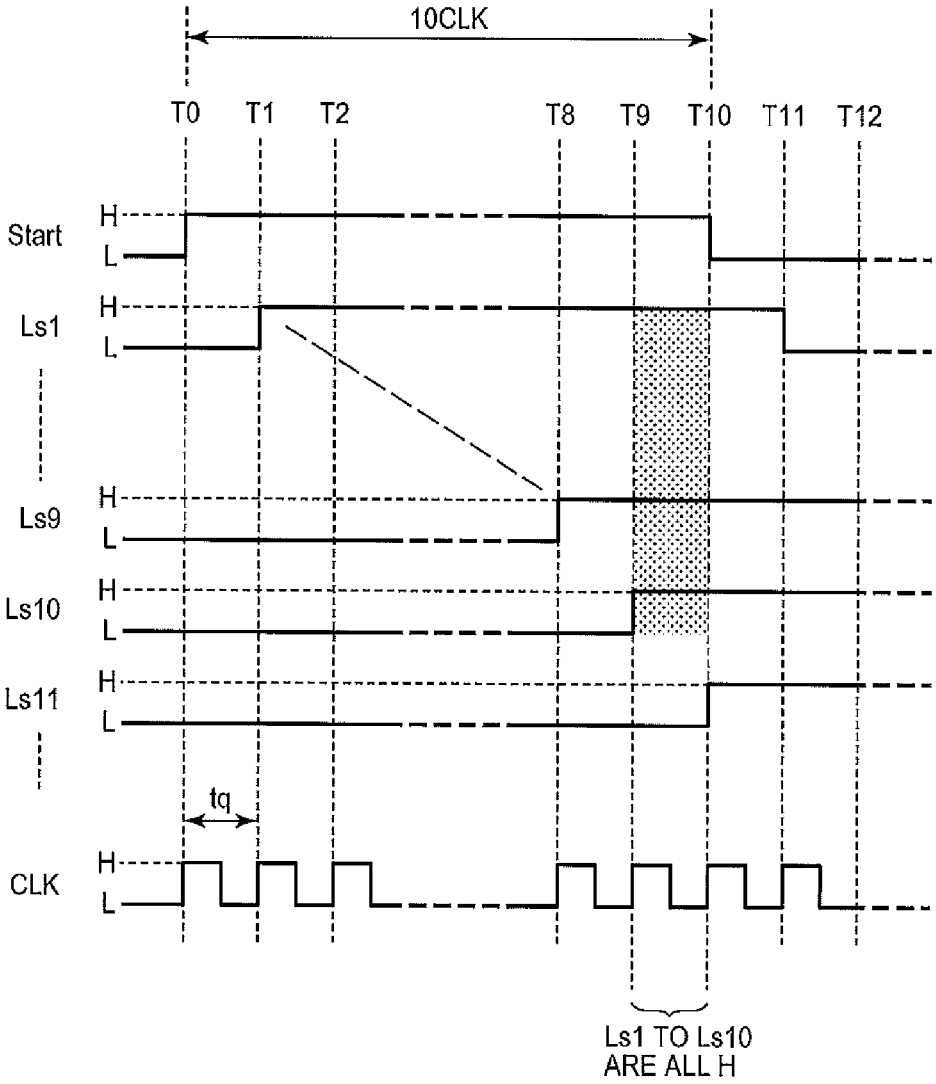
FIG. 11B is a chart for explaining an exemplary method of generating scan signals output to the select lines in the display device of Embodiment 3 of the present invention.

FIG. 11A is an illustration showing an exemplary shift register circuit of the display device of Embodiment 3 of the present invention and FIG. 11B is a chart for explaining an exemplary method of generating scan signals output to the select lines in the display device of Embodiment 3 of the present invention.

The select driver 3 has a shift register circuit as shown in FIG. 11A. Supplied with clock pulses CLK of a given cycle and start pulses Start, the shift register circuit takes in the supplied start pulses Start in time with the clock pulse CLK and sequentially shifts them in accordance with the cycle of the clock pulse CLK.

Here, the duration of an output signal output from the shift register circuit is equal to the duration of a start pulse Start.

During the display operation, at the input terminal of the shift register circuit 50, the cycle of the clock pulse CLK corresponds to the selected time period of each row and the duration of a start pulse Start corresponds to a cycle of the clock pulse CLK.

In this way, the scan signals as shown in FIG. 2A to 2D are output.

On the other hand, during the luminous efficiency acquisition operation in Embodiment 3, the cycle of the clock pulse CLK is equal to a third measuring time period tq. The duration of a start pulse Start is equal to LP cycles of the clock pulse CLK in which LP is the number of rows in a divided region. In other words, for example, when there are 10 select lines in a divided region, as shown in FIG. 11B, the duration of a start pulse Start is equal to 10 cycles of the clock pulse CLK.

The shift register circuit takes in the start pulse Start in time with the clock pulse CLK and sequentially shifts it in accordance with the clock pulse CLK.

Here, the duration of an output signal from the shift register circuit is equal to 10 cycles of the clock pulse CLK corresponding to the duration of a start pulse Start. Therefore, as shown in FIG. 11B, the respective output signals from the shift register circuit overlap with each other. Then, provided that the start pulse Start starts to be supplied at a time T0, the scan signals output to the select line Ls1 to Ls10 all have a high level voltage Vhigh during a time period from T9 to T10 corresponding to the 10th clock pulse CLK. This time period from T9 to T10 is used as the third measuring time period tq in the above FIG. 10A to 10C to realize this embodiment.

Embodiment 4

Embodiment 4 of the present invention will be described hereafter.

In the above Embodiments 1 to 3, the luminous efficiency η of a pixel is acquired based on a pixel, a row, or a given divided region of the display panel and different luminous efficiency η is used for each pixel, each row, or each given region.

On the other hand, in Embodiment 4, the luminous efficiency η acquired at a specific pixel, in a specific row, or in a specific divided region of the display panel is equally applied to all pixels of the display panel.

For example, using the method in Embodiment 1, the luminous efficiency η of any specific pixel, for example a pixel 21 (1,1), of the display panel 2 is acquired and stored in the memory 58.

Then, during the display operation, using the luminous efficiency η stored in memory 58, the correction calculation circuit 53 multiplies each of the voltage data by (1/η) that is a reciprocal of the luminous efficiency η stored in memory 58 to correct the voltage data of all pixels and outputs the voltages corresponding to the corrected voltage data to the data lines Ld1 to Ldm for all rows.

Similarly, using the method in Embodiment 2, the luminous efficiency η of a pixel 21 of m pixels 21 (1,1) to 21 (1,m) of any row, for example the row 1, of the display panel 2 is acquired and stored in the memory 58.

Then, during the display operation, using the luminous efficiency η stored in memory 58, the correction calculation circuit 53 multiplies each of the voltage data by (1/η) that is a reciprocal of the luminous efficiency η stored in memory 58 to correct the voltage data of all pixels and outputs the voltages corresponding to the corrected voltage data to the data lines Ld1 to Ldm for all rows.

Alternatively, using the method in Embodiment 3, the luminous efficiency η of a pixel 21 of multiple pixels 21 in any divided region, for example a divided region P1, among multiple divided regions of the display panel 2 is acquired and stored in the memory 58.

Then, during the display operation, using the luminous efficiency η stored in memory 58, the correction calculation circuit 53 multiplies each of the voltage data by (1/η) that is a reciprocal of the luminous efficiency η stored in memory 58 to correct the voltage data of all pixels and outputs the voltages corresponding to the corrected voltage data to the data lines Ld1 to Ldm for all rows.

As described above, in Embodiment 4, the luminous efficiency η acquired at a specific pixel, in a specific row, or in a specific divided region of the display panel 2 is equally applied to all pixels of the display panel 2.

Consequently, the accuracy of correction of voltage data for the organic EL elements OEL emitting light with luminance equal to the initial state is lowered compared with the above Embodiments 1 to 3. However, the time necessary for the luminous efficiency acquisition operation is significantly reduced compared with Embodiments 1 to 3.

Embodiment 5

Embodiment 5 of the present invention will be described hereafter.

The configuration and operation of the display device according to Embodiment 5 includes the same configuration and operation as those of the display device 1 of the above Embodiments 1 to 4. The following explanation will focus on the difference from the above embodiments and explanation of the components equivalent to those of the above embodiments will be omitted or simplified.

First, configuration of the display device (light emitting device) according to Embodiment 5 will be described.

Figure 12:
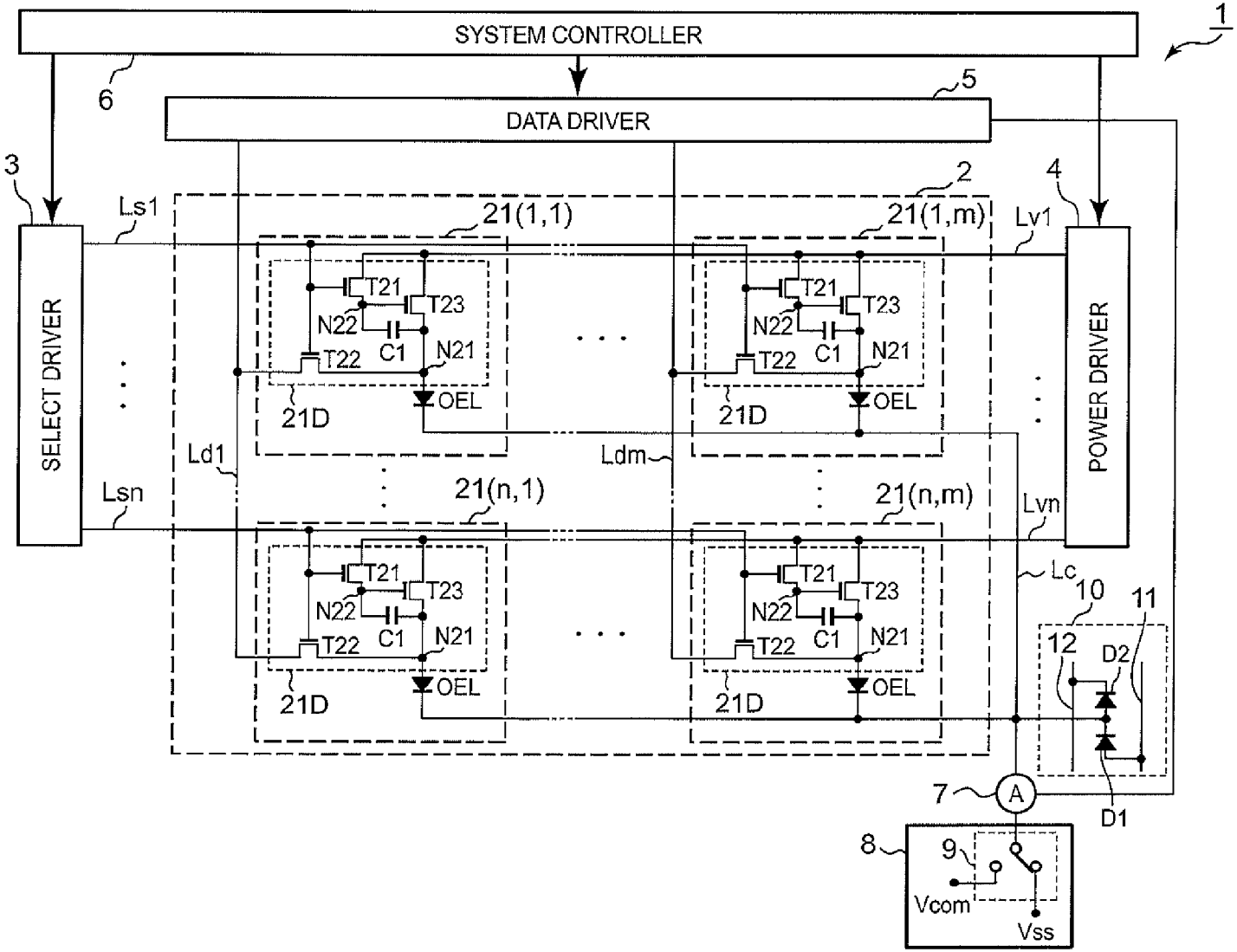
FIG. 12 is an illustration showing an exemplary configuration of the display device according to Embodiment 5 of the present invention.

FIG. 12 is an illustration showing an exemplary configuration of the display device according to Embodiment 5 of the present invention.

The display device 1 has, as shown in FIG. 12, a display panel 2, a select driver 3, a power driver 4, a data driver 5, a system controller 6, a ammeter 7, a cathode circuit 8, and a protection circuit 10.

In other words, the display device 1 according to Embodiment 5 is provided with the protection circuit 10 in addition to the configuration equivalent to the display device 1 of the above Embodiments 1 to 4.

The protection circuit 10 is a static protection circuit preventing damage such as destruction of the transistors of the pixels 21 in case of high voltage static pulses entering the display device 1 from an external source.

The protection circuit 10 is electrically connected to a power line 11 supplying a low potential power VL and a power line 12 supplying a high potential power VH and releases static pulses to the power line 11 or 12.

The protection circuit 10 comprises, for example, two diodes D1 and D2 series-connected. The anode of the diode D1 is connected to the power line 11 supplying a low potential power VL. The cathode of the diode D2 is connected to the power line 12 supplying a high potential power VH. In this way, the diodes D1 and D2 are inversely-biased and exhibit sufficiently high resistance in a normal range of drive voltages. Therefore, during the normal display operation, they do not interfere with light emission of the organic EL elements OEL or deteriorate the image quality of the display device 1.

In practice, multiple such static protection circuits 10 are provided to the select lines Ls1 to Lsn, data lines Ld1 to Ldm, power lines Lv1 to Lvn, and common cathode electrode Lc.

For convenience, the protection circuit 10 on the current passage from the data line Ld1 to the common cathode electrode Lc via the organic EL element OEL of a pixel 21 (1,1) shown in FIG. 12 represents, for example, multiple protection circuits provided to the data lines Ld1 to Ldm and common cathode electrode Lc. The protection circuit 10 is provided also to each of the select lines Ls1 to Lsn and each of the power lines Lv1 to Lvn. However, those protection circuits have no influence on the present embodiment and, therefore, are not shown in the figure.

Here, in the protection circuit 10, when static pulses having a potential lower than the voltage applied to the power line 11 enter the common cathode electrode Lc, the static pulses flow into the low potential power line 11 via the diode D1. When static pulses having a potential higher than the voltage applied to the power line 12 enter the common cathode electrode Lc, the static pulses flow into the high potential power line 12 via the diode D2.

However, the protection circuit 10 includes, as described above, for example, two diodes D1 and D2 series-connected and inversely-biased. Therefore, there may be a tiny amount of leak current Ir flowing through the inversely-biased diodes D1 and D2. Such a leak current Ir may flow into the common cathode electrode Lc from the protection circuit 10, or there may be a leak current Ir flowing out from the common cathode electrode Lc into the protection circuit 10.

If such a leak current Ir is present, the current I flowing through the common cathode electrode Lc consists of the current flowing through the series circuits consisting of the transistors T22 and organic EL elements OEL of pixels 21 plus/minus the leak current Ir. Therefore, the current value of a current measured by the ammeter 7 may contain an error for the leak current Ir of the protection circuit 10, lowering the accuracy of the acquired luminous efficiency.

Then, the display device according to Embodiment 5 prevents the current value of a current measured by the ammeter 7 from containing an error caused by the leak current Ir of the protection circuit 10 so that the accuracy of the acquired luminous efficiency is not lowered when the display device 1 is provided with the protection circuit 10.

The luminous efficiency acquisition operation according to Embodiment 5 will be described with reference to the drawings.

Figure 13:
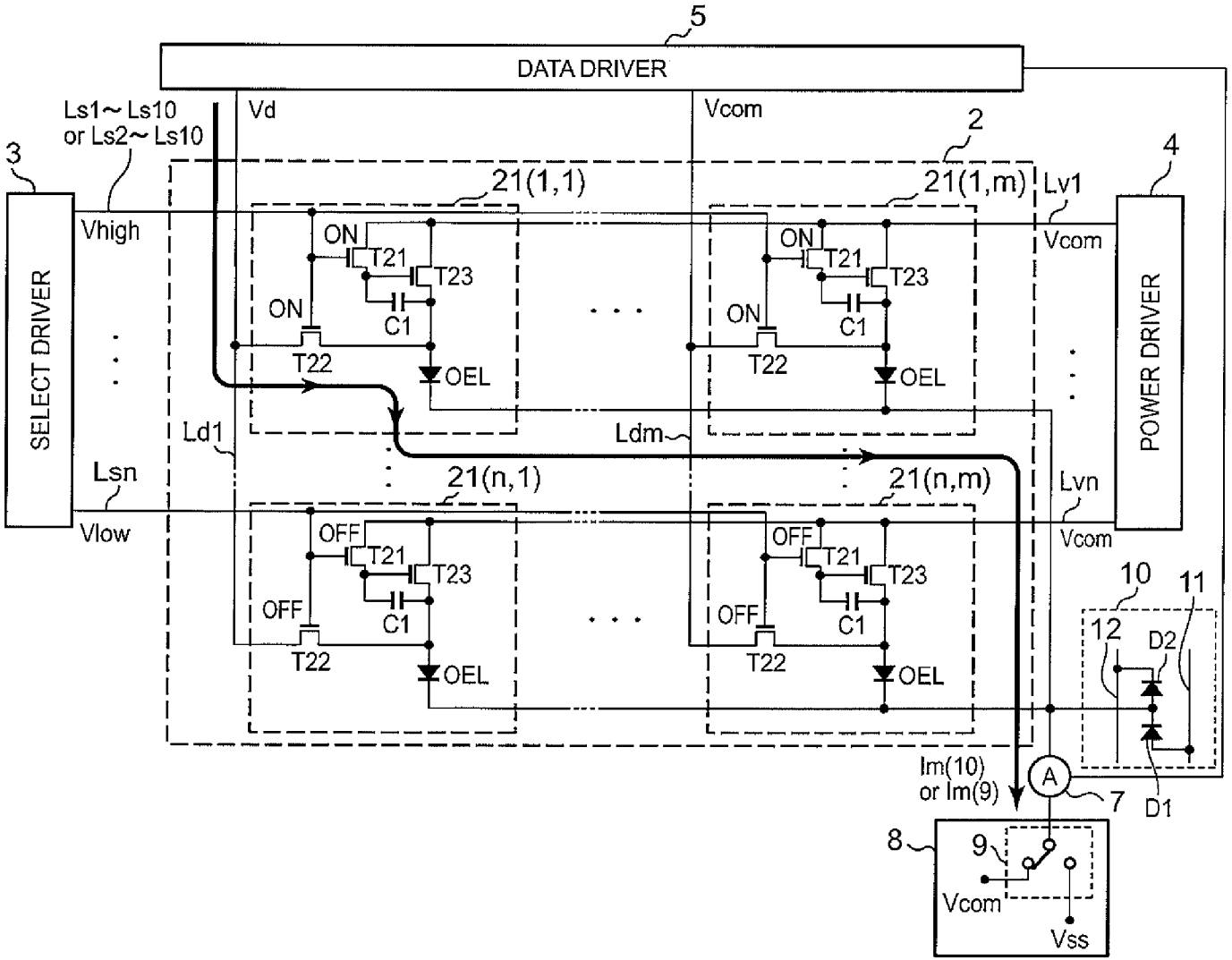
FIG. 13 is an illustration showing an exemplary luminous efficiency acquisition operation in the display device of Embodiment 5 of the present invention.

FIG. 13 is an illustration showing an exemplary luminous efficiency acquisition operation in the display device of Embodiment 5 of the present invention. Here, the luminous efficiency acquisition operation to acquire the luminous efficiency 1(1,1) of the organic EL element OEL of a pixel 21 (1,1) of the row 1 and column 1 will be described.

In the luminous efficiency acquisition operation, grouping, for example, ten select lines Ls, the select driver 3 simultaneously outputs scan signals of a high level voltage Vhigh to the select lines Ls1 to Ls10 to simultaneously select the select lines Ls1 to Ls10.

Here, an exemplary method of the select driver 3 simultaneously outputting scan signals of a high level voltage Vhigh to the select lines Ls1 to Ls10 to simultaneously select the select lines Ls1 to Ls10 is described.

Figure 14A:
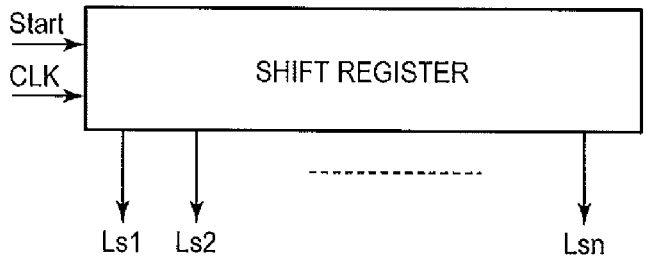
FIG. 14A is an illustration showing an exemplary shift register of the display device of Embodiment 5 of the present invention.
Figure 14B:
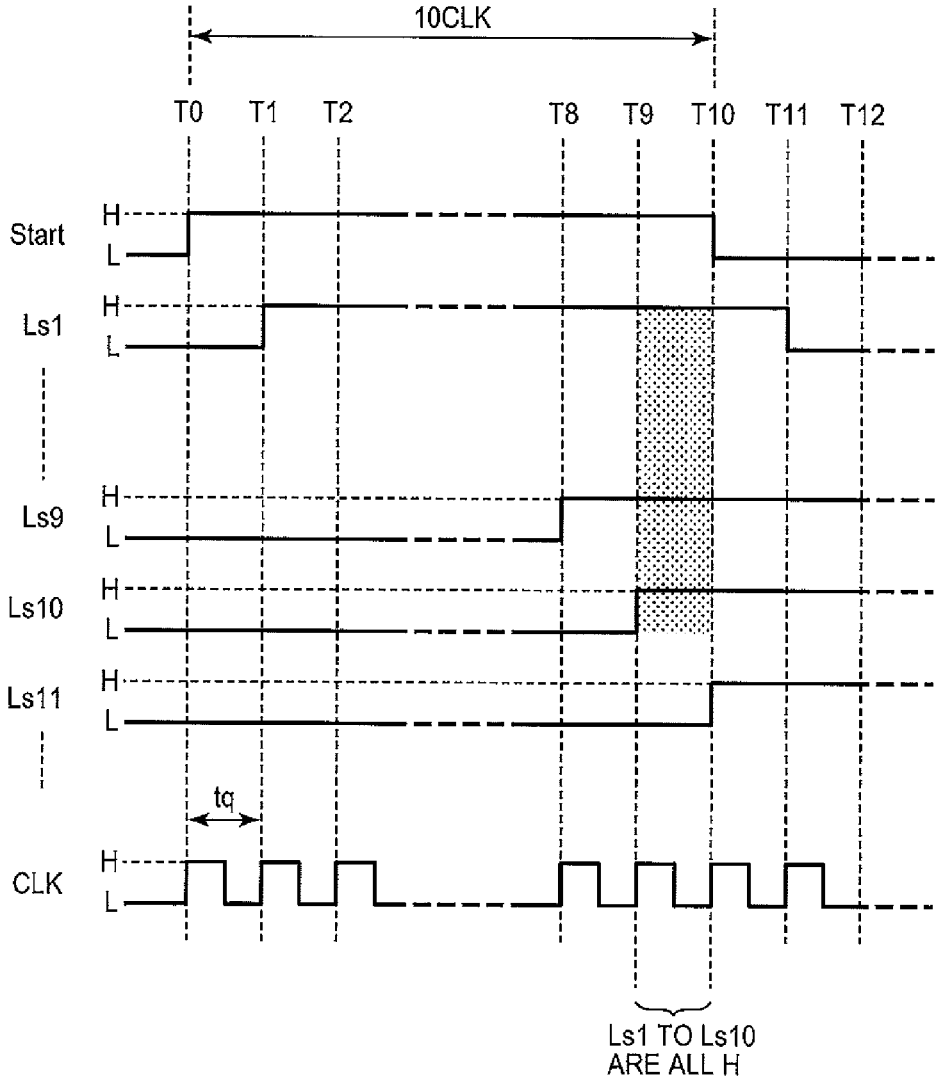
FIG. 14B is a chart for explaining an exemplary method of generating scan signals output to the select lines in the display device of Embodiment 5 of the present invention.

FIG. 14A is an illustration showing an exemplary shift register of the display device of Embodiment 5 of the present invention and FIG. 14B is a chart for explaining an exemplary method of generating first scan signals output to the select lines in the display device of Embodiment 5 of the present invention.

Figure 15:
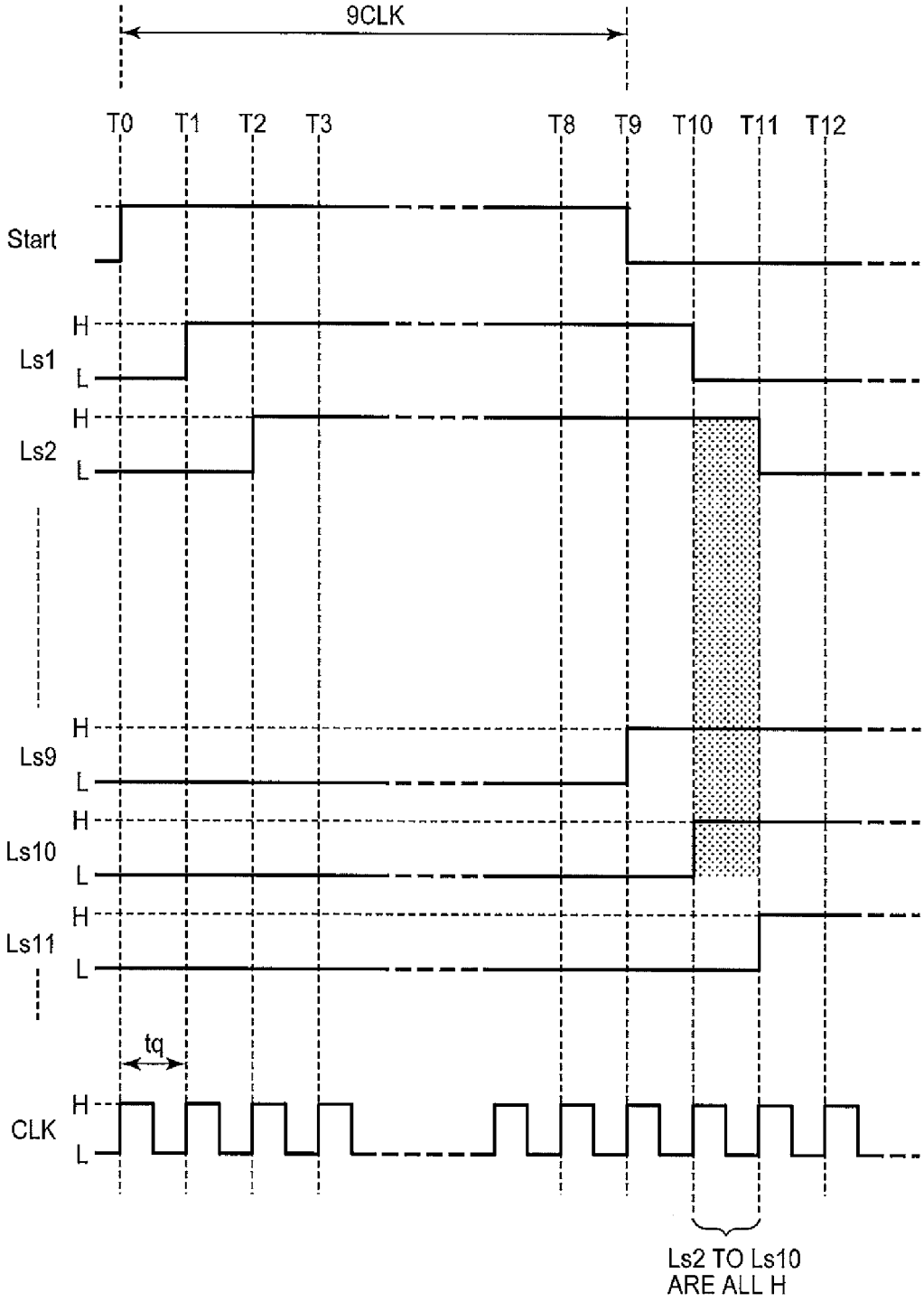
FIG. 15 is a chart for explaining an exemplary method of generating scan signals output to the select lines in the display device of Embodiment 5 of the present invention.

FIG. 15 is a chart for explaining an exemplary method of generating second scan signals output to the select lines in the display device of Embodiment 5 of the present invention.

The select driver 3 has a shift register circuit as shown in FIG. 14A. Supplied with clock pulses CLK of a given cycle and start pulses Start, the shift register circuit takes in the supplied start pulses Start and sequentially shifts them in accordance with the cycle of the clock pulse CLK. The duration of an output signal output from the shift register circuit is equal to the duration of a start pulse Start.

In the case of a group of 10 select lines, as shown in FIG. 14B, the duration of a start pulse Start is equal to 10 cycles tq of the clock pulse CLK.

The shift register circuit takes in the start pulses Start and sequentially shifts and outputs them in accordance with the clock pulses CLK.

Here, the duration of an output signal from the shift register circuit is equal to 10 cycles of the clock pulse CLK corresponding to the duration of a start pulse Start. Therefore, as shown in FIG. 14B, the output signals output from the shift register circuit overlap with each other. Then, provided that the start pulse Start starts to be supplied at a time T0, the scan signals output to the select lines Ls1 to Ls10 all have a high level voltage Vhigh during a time period from T9 to T10 corresponding to the 10th clock pulse CLK. This time period from T9 to T10 is used to simultaneously output scan signals of a high level voltage Vhigh to the select lines Ls1 to Ls10 so as to simultaneously select the select lines Ls1 to Ls10.

The power driver 4 applies a common voltage Vcom (for example, −10V) to all power lines Lv1 to Lvn.

The data driver 5 applies a set voltage Vd (for example, −3 V) to the data lines Ld1 and a common voltage Vcom (for example, −10V) to the data lines Ld2 to Ldm at least during the above time period from T9 to T10.

The cathode circuit 8 shifts the switch 9 to apply a common voltage Vcom (for example, −10V) to the other end of the ammeter 7.

Then, as shown in FIG. 13, the transistors T22 of the pixels 21 (1,1) to 21 (10,1) in the column 1 of the rows 1 to 10 are turned on.

Then, since −3 V is applied to the data line Ld1 and −10 V is applied to the cathode circuit 8, approximately 7 V of voltage drop occurs between the anode and cathode of each of the organic EL elements OEL of the pixels 21 (1,1) to 21 (10,1) and a current flows.

On the other hand, the transistors T22 of the pixels 21 (1,2) to 21 (10,m) in the columns 2 to m of the rows 1 to 10 are also turned on. However, since −10 V is applied to the data lines Ld2 to Ldm and also to the cathode circuit 8, they are equal in potential. Therefore, no current flows through the organic EL elements OEL of these pixels 21 (1,2) to 21 (10,m).

As for the pixels in the rows 11 to n, the transistors T21, T22, and T23 are all turned off. Therefore, no current flows through the organic EL elements OEL.

Consequently, the current flowing from the data driver 5 to the cathode circuit 8 via the ten transistors T22 and organic EL elements OEL of the pixels 21 (1,1) to 21 (10,1) in the column 1 of the rows 1 to 10 and the common cathode electrode Lc flows through the ammeter 7. This current is referred to as a first measuring current Im1 (10).

The current value of the first measuring current Im1 (10) is measured by the ammeter 7 and supplied to the ADC 56.

The ADC 56 converts the current value of the first measuring current Im1 (10) to digital data and supplies it to the luminous efficiency acquisition part 57.

Here, it is assumed that the detection current flowing through the organic EL element OEL of a pixel 21 (1,1) is Id1, the detection current flowing through the organic EL element OEL of a pixel 21 (2,1) is Id2, . . . , the detection current flowing through the organic EL element OEL of a pixel 21 (n,1) is Idn, and the total of detection currents flowing through the ten organic EL elements OEL of pixels 21 (1,1) to 21 (10,1) is the first total detection current Id1 (10). Then, the first total detection current Id1 (10) is expressed by the formula (1) below.

If a leak current Ir flows into the common cathode electrode Lc from the protection circuit 10, the first measuring current Im1 (10) is expressed by the formula (2) below.

$$Id1(10)=Id1+Id2+\ldots+Id10 \quad (1)$$

$$Im1(10)=Id1(10)+Ir \quad (2)$$

Then, the select driver 3 simultaneously outputs scan signals of a high level voltage Vhigh to the select lines Ls2 to Ls10 to simultaneously select the select lines Ls2 to Ls10. Then, the current value of a current flowing through the ammeter 7 is measured in the same manner as described above.

Here, for simultaneously selecting the select lines Ls2 to Ls10, the same method as described above for simultaneously selecting the select lines Ls1 to Ls10 can apply.

In this case, as shown in FIG. 15, the duration of a start pulse Start is equal to nine cycles tq of the clock pulse CLK. In this way, as shown in FIG. 15, the scan signals output to the select lines Ls2 to Ls10 all have a high level voltage Vhigh during a time period from T10 to T11 of the start clock.

The data driver 5 applies a set voltage Vd (for example, −3 V) to the data line Ld1 and a common voltage Vcom (for example, −10V) to the data lines Ld2 to Ldm at least during the time period from T10 to T11.

The cathode circuit 8 shifts the switch 9 to apply a common voltage Vcom (for example, −10V) to the other end of the ammeter 7.

Consequently, the transistors T22 of the pixels 21 (2,1) to 21 (10,1) in the column 1 of the rows 2 to 10 are turned on.

Then, since −3 V is applied to the data line Ld1 and −10 V is applied to the cathode circuit 8, approximately 7 V of voltage drop occurs between the anode and cathode of each of the organic EL elements OEL of the pixels 21 (2,1) to 21 (10,1) and a current flows. On the other hand, the transistors T22 of the pixels 21 (2,2) to 21 (10,m) in the columns 2 to m of the rows 2 to 10 are also turned on. However, since −10 V is applied to the data lines Ld2 to Ldm and also to the cathode circuit 8, they are equal in potential. Therefore, no current flows through the organic EL elements OEL of these pixels 21 (2,2) to 21 (10,m).

As for the pixels in the rows 1 and 11 to n, the transistors T21, T22, and T23 are all turned off. Therefore, no current flows.

Consequently, the current flowing from the data driver 5 to the cathode circuit 8 via the nine transistors T22 and organic EL elements OEL of the pixels 21 (2,1) to 21 (10,1) in the column 1 of the rows 2 to 10 and the common cathode electrode Lc flows through the ammeter 7. This current is referred to as a second measuring current Im1 (9).

The current value of the second measuring current Im1 (9) is measured by the ammeter 7 and supplied to the ADC 56.

The ADC 56 converts the current value of the second measuring current Im1 (9) to digital data and supplies it to the luminous efficiency acquisition part 57.

Here, the total of detection currents flowing through the nine organic EL elements OEL of pixels 21 (2,1) to 21 (10,1) is referred to as a second total detection current Id1 (9), and the second total detection current Id1 (9) is expressed by the formula (3) below.

If a leak current Ir flows into the common cathode electrode Lc from the protection circuit 10, the second measuring current Im1 (9) is expressed by the formula (4) below.

Here, both the first measuring current Im1 (10) and the second measuring current Im1 (9) flow through the data line Ld1 and common cathode electrode Lc, they share the same leak current Ir flowing in from the protection circuit 10.

$$Id1(9)=Id2+Id3+\ldots+Id10 \quad (3)$$

$$Im1(9)=Id1(9)+Ir \quad (4)$$

Then, the difference in current value between the first measuring current Im1 (10) and second measuring current Im1 (10) is obtained using the formulae (2) and (4) as presented by the formula (5).

Consequently, the leak current Ir is canceled and the current value of a detection current Id1 flowing through the organic EL element OEL of a pixel 21 (1,1) can be obtained.

Here, even if a leak current Ir flows out from the common cathode electrode Lc into the protection circuit 10, it will be similarly cancelled.

$$Im1(10)-Im1(9)=(Id1(10)+Ir)-(Id1(9)+Ir)=Id1(10)-Id1(9)=Id1 \quad (5)$$

The luminous efficiency acquisition part 57 acquires the current value of the detection current Id1 flowing through the organic EL element OEL of the pixel 21 (1,1) based on the above formula (5).

The luminous efficiency acquisition part 57 supplies the acquired current value of the detection current Id1 to the memory 58 and the memory 58 stores the current value of the detection current Id1. Here, the detection current Id1 corresponds to the detection current Id in FIG. 4.

The luminous efficiency acquisition part 57 calculates the change rate of the current value of the detection current Id1 (detection current Id) with respect to the initial current I0. Then, the luminous efficiency acquisition part 57 makes reference to the look-up table using the value of the change rate (Id/10) to acquire the corresponding luminous efficiency η (1,1) of the organic EL element OEL of the pixel 21 (1,1) of the row 1 and column 1.

The luminous efficiency acquisition part 57 supplies the extracted luminous efficiency η (1,1) to the memory 58 and the memory 58 stores the luminous efficiency η (1,1) in association with the pixel 21 (1,1).

As described above, the luminous efficiency η (1,1) of the organic EL element OEL of the pixel 21 (1,1) of the row 1 and column 1 is acquired and stored in the memory 58.

Then, the display device 1 repeats the above operation while the data driver 5 applies a set voltage Vd to the data lines Ld2 to Ldm in turn to acquire and store in the memory 58 the luminous efficiency η (1,2) to η (1,m) of the organic EL elements OEL of the pixel 21 (1,2) to 21 (1,m) of the columns 2 to m in the row 1.

The display device 1 of this embodiment performs the above operation for all select lines Ls1 to Lsn of the display panel 2.

Consequently, the luminous efficiency acquisition part 57 acquires the luminous efficiency η (1,1) to η (n,m) of the organic EL elements OEL of all pixel 21 (1,1) to 21 (n,m) and stores it in the memory 58 in association with the pixels 21 (1,1) to 21 (n,m).

After all luminous efficiency η (1,1) to η (n,m) is stored in the memory 58, the system controller 6 ends the luminous efficiency acquisition operation.

In the above explanation, ten select lines Ls are grouped. This is not restrictive and two or more select lines Ls can be grouped.

The display operation to display images with correction using the acquired luminous efficiency η (1,1) to η (n,m) in Embodiment 5 is performed in the same manner as in the above Embodiment 1 and, therefore, the explanation is omitted.

As described above, in the luminous efficiency acquisition operation of Embodiment 5, the current value of a detection current Id flowing through the organic EL element OEL of each pixel 21 is obtained while eliminating influence of a leak current Ir of the protection circuit 10. Then, the change rate of the current value of the detection current Id with respect to the initial current I0 is obtained and the value of the change rate is used to acquire the luminous efficiency η of each pixel 21. Then, during the display operation, the voltage data corresponding to image data are respectively multiplied by 1/η for correction and corrected voltages corresponding the corrected voltage data are respectively applied to the pixels 21, whereby display (light emission) with luminance equal to the initial state can be conducted for the same data even if deterioration over time has occurred.

Embodiment 6

Embodiment 6 of the present invention will be described hereafter.

In the above Embodiment 5, the luminous efficiency η of the organic EL element OEL of each of multiple pixels of the display panel is extracted. In such a case, when the number of pixels is increased as in a large panel or in a high resolution panel, the time necessary for the luminous efficiency acquisition operation is increased according to the number of pixels.

On the other hand, in Embodiment 6 below, multiple pixels in each row of the display panel are collectively measured while eliminating influence of the leak current Ir in the protection circuit 10 as in the above Embodiment 5, and the measured value is used to acquire the luminous efficiency of a pixel as the average value per pixel. Consequently, the time required for the luminous efficiency acquisition operation can be reduced compared with Embodiment 5.

Operation of the display device 1 according to Embodiment 6 will be described with reference to the drawings.

Figure 16:
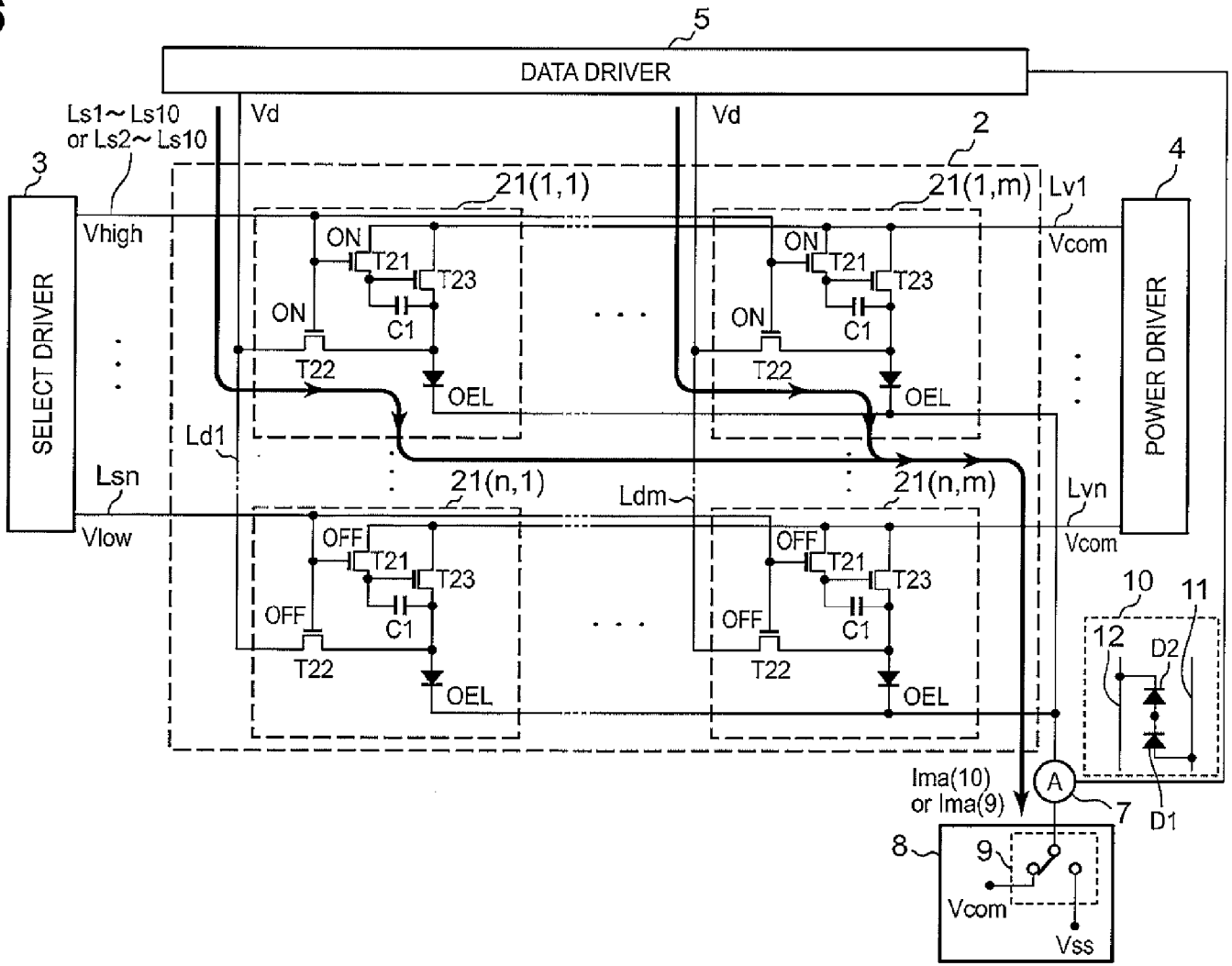
FIG. 16 is an illustration showing an exemplary luminous efficiency acquisition operation in the display device of Embodiment 6 of the present invention.

FIG. 16 is an illustration showing an exemplary luminous efficiency acquisition operation in the display device of Embodiment 6 of the present invention.

The configuration and operation of the display device according to Embodiment 6 includes the same configuration and operation as those of the display device of the above Embodiment 5. The following explanation will focus on the difference from Embodiment 5 and explanation of the components equivalent to those of the above Embodiment 5 will be omitted or simplified.

First, the luminous efficiency acquisition operation to acquire the luminous efficiency $\eta_1$ of the organic EL element OEL of a pixel 21 as the average value per pixel 21 from m pixels 21 in the row 1 will be described.

In the luminous efficiency acquisition operation, grouping, for example, ten select lines Ls, the select driver 3 simultaneously outputs scan signals of a high level voltage Vhigh to the select lines Ls1 to Ls10 to simultaneously select the select lines Ls1 to Ls10 in the same manner as in the above Embodiment 5.

As a method of the select driver 3 simultaneously outputting scan signals of a high level voltage Vhigh to the select lines Ls1 to Ls10 to simultaneously select the select lines Ls1 to Ls10, for example, the above-described configuration shown in FIG. 14B can apply.

Then, the data driver 5 applies a set voltage Vd (for example, −3 V) to all data lines Ld1 to Ldm at least during the above time period from T9 to T10.

The cathode circuit 8 shifts the switch 9 to apply a common voltage Vcom (for example, −10V) to the other end of the ammeter 7.

Consequently, as shown in FIG. 16, the transistors T22 of the pixels 21 (1,1) to 21 (10,m) of all columns in the rows 1 to 10 are turned on. Then, since −3 V is applied to the data line Ld1 and −10 V is applied to the cathode circuit 8, approximately 7 V of voltage drop occurs between the anode and cathode of each of the organic EL elements OEL of the pixels 21 and a current flows.

As for the pixels in the rows 11 to n, the transistors T21, T22, and T23 are all turned off. Therefore, no current flows through the organic EL elements OEL.

Consequently, the current flowing from the data driver 5 to the cathode circuit 8 via the transistors T22 and organic EL elements OEL of all pixels 21 (1,1) to 21 (10,m) in the rows 1 to 10 and the common cathode electrode Lc flows through the ammeter 7.

This current is referred to as a first total measuring current Ima1 (10). The first total measuring current Ima1 (10) contains the leak current Ir from the protection circuit 10.

The current value of the first total measuring current Ima1 (10) is measured by the ammeter 7 and supplied to the ADC 56.

The ADC 56 converts the current value of the first total measuring current Ims1 (10) to digital data and supplies it to the luminous efficiency acquisition part 57.

Then, the select driver 3 simultaneously outputs scan signals of a high level voltage Vhigh to the select lines Ls2 to Ls10 to simultaneously select the select lines Ls2 to Ls10 in the same manner as in the above Embodiment 5.

As a method of simultaneously outputting scan signals of a high level voltage Vhigh to the select lines Ls2 to Ls10 to simultaneously select the select lines Ls2 to Ls10, for example, the above-described configuration shown in FIG. 15 can apply.

The data driver 5 applies a set voltage Vd to all data line Ld1 to Ldm at least during the above time period from T10 to T11.

The cathode circuit 8 shifts the switch 9 to apply a common voltage Vcom (for example, −10V) to the other end of the ammeter 7.

Consequently, the current flowing from the data driver 5 to the cathode circuit 8 via the transistors T22 and organic EL elements OEL of all pixels 21 (2,1) to 21 (10,m) in the rows 2 to 10 and the common cathode electrode Lc flows through the ammeter 7. This current is referred to as a second total measuring current Ima1 (9). The second total measuring current Ima1 (9) also contains the leak current Ir from the protection circuit 10.

The current value of the second total measuring current Ima1 (9) is measured by the ammeter 7 and supplied to the ADC 56.

The ADC 56 converts the current value of the second total measuring current Ima1 (9) to digital data and supplies it to the luminous efficiency acquisition part 57.

Then, the luminous efficiency acquisition part 57 acquires the difference in current value between the first total measuring current Ima1 (10) and second total measuring current Ima1 (9).

Consequently, the leak current Ir is canceled in the same manner as in the above Embodiment 5 and the current value of a total detection current Ida that is the total of detection currents Id flowing through the organic EL elements OEL of m pixels 21 (1,1) to 21 (1,m) in the row 1 can be obtained.

Then, the luminous efficiency acquisition part 57 multiplies the current value of the total detection current Ida by 1/m to acquire the average detection current Id per organic EL element OEL of a pixel 21 in the row 1.

Then, the luminous efficiency acquisition part 57 calculates the change rate of the current value of the acquired, average detection current Id with respect to the initial current I0. Then, the luminous efficiency acquisition part 57 makes reference to the look-up table using the value of the change rate (Id/10) to acquire the corresponding luminous efficiency $\eta_1$ of the organic EL elements OEL of the pixels 21 in the row 1.

The luminous efficiency acquisition part 57 supplies the extracted luminous efficiency $\eta_1$ to the memory 58 and the memory 58 stores the luminous efficiency $\eta_1$ in association with the row 1.

The display device 1 of this embodiment performs the above operation for all select lines Ls1 to Lsn of the display panel 2.

Consequently, the luminous efficiency acquisition part 57 acquires the luminous efficiency $\eta_1$ to $\eta_n$ of the organic EL elements OEL of the pixels 21 in the individual rows and stores it in the memory 58.

During the display operation, the luminous efficiency $\eta_1$ to $\eta_n$ stored in the memory 58 and associated with each of the row is used to correct the voltage data corresponding to each of the pixels.

Consequently, also in Embodiment 6, the corrected data voltages ($1/\eta_n$) times higher than the uncorrected ones are respectively applied to the pixels and, accordingly, approximately ($1/\eta_n$) times larger currents flow respectively through the pixels, whereby display (light emission) with luminance equal to the initial state can be conducted as in Embodiment 5.

In Embodiment 6, the time necessary for the luminous efficiency acquisition operation is decreased to approximately 1/m of the time necessary for the luminous efficiency acquisition operation in the above Embodiment 5 provided that there is m pixels 21 in a row; the time necessary for the luminous efficiency acquisition operation can be reduced compared with Embodiment 5.

Modified Embodiments

Modified embodiments of the above embodiments of the present invention will be described hereafter.

In the configurations presented in the above embodiments, the voltage values set at the parts are given by way of example. The mutual potential relations are determined on an arbitrary basis as long as writing in the selected pixels and light emission of pixels in non-selected rows are properly conducted during the display operation and the current flowing through the organic EL elements can be measured during the luminous efficiency acquisition operation.

In other words, it is satisfactory that the voltages have the mutual potential relations satisfying the following conditions (1) to (4) during the display operation and satisfying the following conditions (5) to (7) during the luminous efficiency acquisition operation.

During the display operation, (1) the high level voltage Vhigh applied to the select lines Ls turns on the transistors T21 and T22 of the pixels 21 in selected rows and the low level voltage Vlow turns off the transistors T21 and T22 of the pixels 21 in non-selected rows; (2) the voltage Vcc applied to the power lines Lv and the reference voltage Vss turn on the transistors T23 of the pixels 21 in selected rows and turns off the transistors T23 of the pixels 21 in non-selected rows; (3) a given voltage is applied to the cathodes of the organic EL elements OEL via the switch 9 and ammeter 7; and (4) the voltage applied to each of the data lines Ld is higher in potential than the given voltage.

During the luminous efficiency acquisition operation, (5) the transistors T22 of pixels 21 in a row containing one or multiple pixels through which a detection current is to flow are turned on and the transistors T22 of pixels 21 in the other rows are turned off; (6) no current flows through the transistors T21 and transistors T23 of all pixels (for example, the voltage of the power lines Lv and the voltage applied to the other end of the ammeter 7 via the switch 9 are equal); and (7) the voltage applied to the data line Ld of a column containing one or multiple pixels through a detection current is to flow is higher in potential than the voltage applied to the other end of the ammeter 7 and the voltage applied to the data lines Ld of the other columns and the voltage applied to the other end of the ammeter 7 are equal in potential.

Figure 17A:
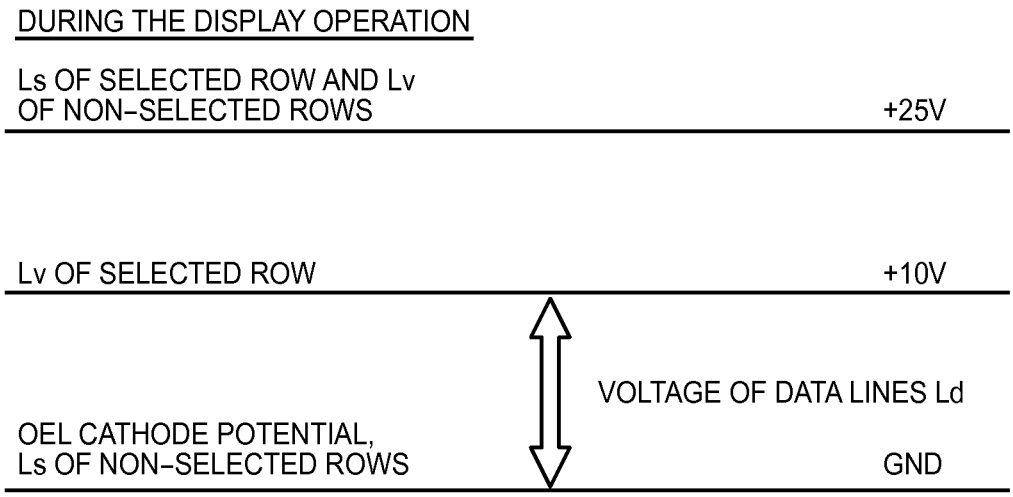
FIG. 17A is an illustration showing exemplary voltages or currents at the parts of the pixel drive circuit during the display operation of a modified embodiment of the above embodiments of the present invention.
Figure 17B:
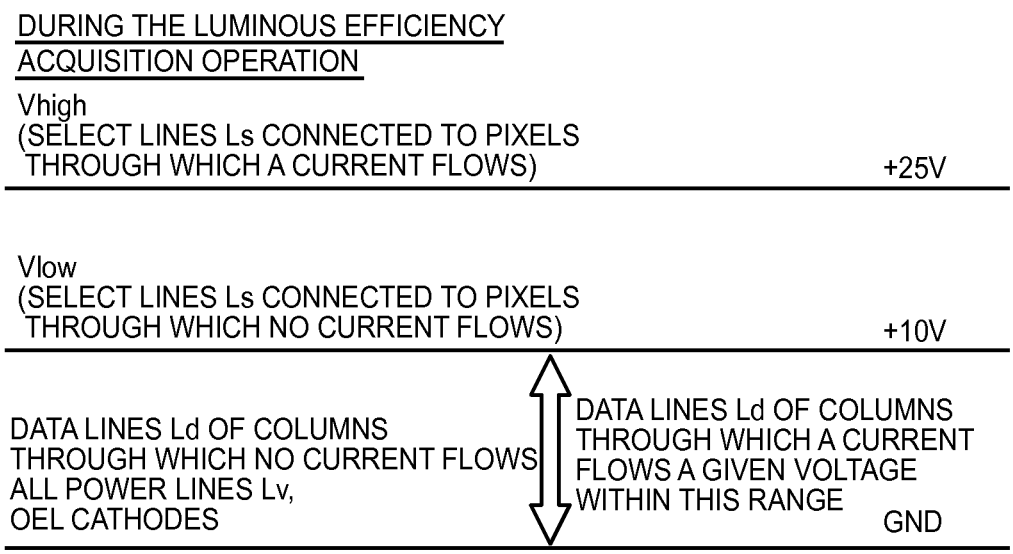
FIG. 17B is an illustration showing exemplary voltages or currents at the parts of the pixel drive circuit during the luminous efficiency acquisition operation of a modified embodiment of the above embodiments of the present invention.

For example, as shown in FIGS. 17A and 17B, the voltages within the circuit can be positive voltages.

As shown in the figures:

(During the Display Operation)

i) Vhigh of scan signals applied to the select lines Ls is set to 25 V and Vlow is set to 0 V (GND);

ii) The voltage Vcc applied to the power lines Lv is set to +25 V and the reference voltage Vss is set to +10 V; and iii) The voltages applied to the data lines Ld are set to voltages between +10 V and the ground voltage (GND) in accordance with the gradation.

(During the Luminous Efficiency Acquisition Operation)

i) Vhigh of scan signals applied to the select line Ls of a row containing one or multiple pixels through which a detection current is to flow is set to 25 V and Vlow of scan signals applied to the select lines of the rows containing the pixels 21 of the other rows is set to 0 V (GND);

ii) The voltage applied to all power lines Lv is set to 0 V (ground potential);

iii) The voltage applied to the cathodes of organic EL elements OEL via the switch 9 and ammeter 7 is set to 0 V; and iv) The voltage applied to the data line Ld of a column containing one or multiple pixels through which a detection current is to flow is set to a voltage higher in potential than 0 V.

Figure 17C:
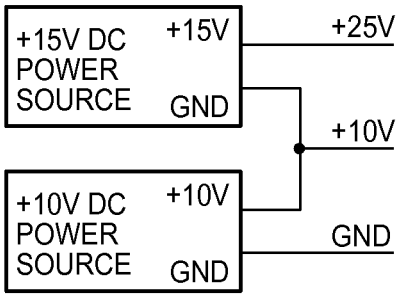
FIG. 17C is an illustration showing an exemplary power source configuration for driving the pixel drive circuit of a modified embodiment of the above embodiments of the present invention.

The above multiple voltages can be generated, for example, by connecting a +15 V DC power source and a +10 V DC power source as shown in FIG. 17C.

For implementing the present invention, various modifications can be made and the present invention is not confined to the above embodiments.

For example, in the above embodiments, the light emitting elements are organic EL elements. However, the light emitting elements are not restricted to organic EL elements and can be, for example, inorganic EL elements or LEDs.

<Exemplary Applications in Electronic Devices>

Electronic devices to which the display devices according to the above-described embodiments or the like are applied will be described hereafter with reference to the drawings.

The display device 1 described in the above embodiments is suitably applicable to various electronic devices such as digital cameras, personal computers, and cell-phones as their display device.

Figure 18A:
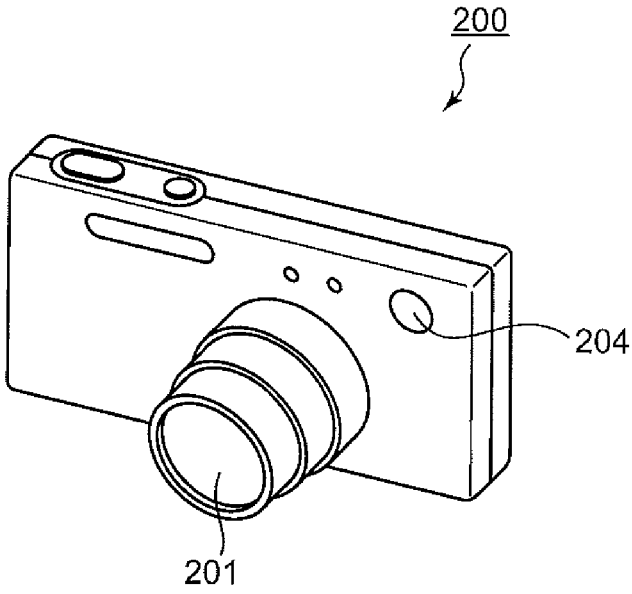
FIG. 18A is a perspective front view showing an exemplary structure of a digital camera to which the display device according to the embodiments and the modified embodiment of the present invention is applied.
Figure 18B:
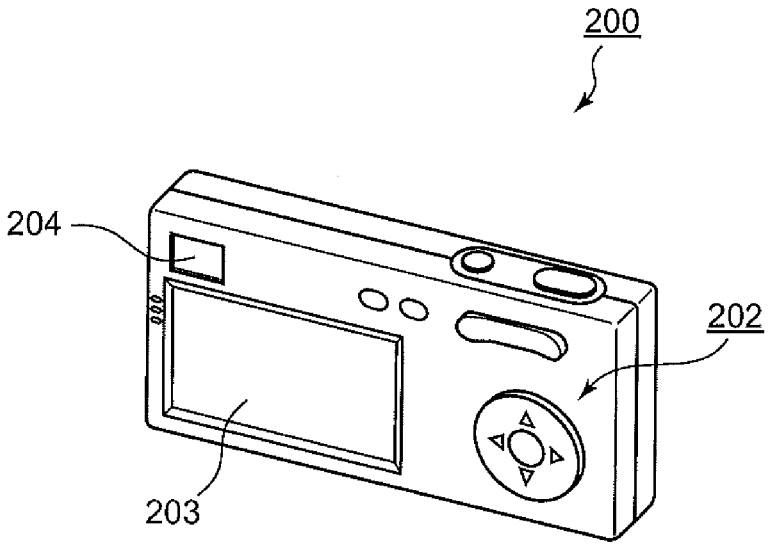
FIG. 18B is a perspective rear view showing an exemplary structure of the digital camera to which the display device according to the embodiments and the modified embodiment of the present invention is applied.

FIGS. 18A and 18B are a perspective views showing an exemplary structure of a digital camera to which the display device according to the embodiments and the modified embodiment of the present invention is applied.

Figure 19:
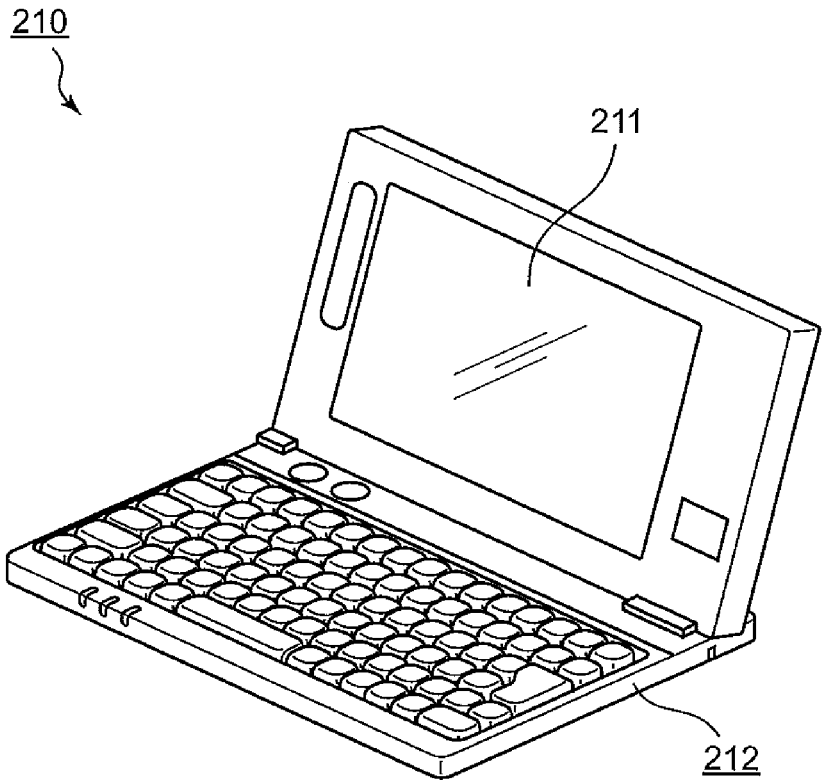
FIG. 19 is a perspective view showing an exemplary structure of a personal computer to which the display device according to the embodiments and the modified embodiment of the present invention is applied.

FIG. 19 is a perspective view showing an exemplary structure of a personal computer to which the display device according to the embodiments and the modified embodiment of the present invention is applied.

Figure 20:
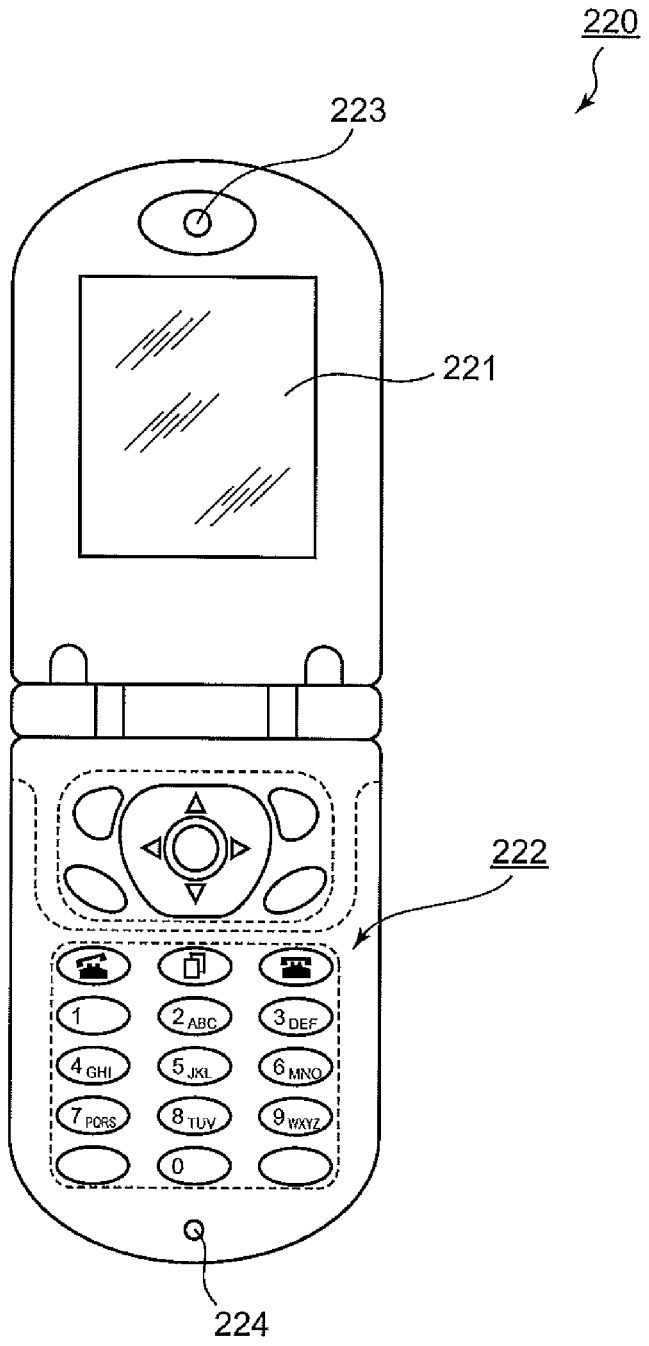
FIG. 20 is an illustration showing an exemplary structure of a cell-phone to which the display device according to the embodiments and the modified embodiment of the present invention is applied.

FIG. 20 is a perspective view showing an exemplary structure of a cell-phone to which the display device according to the embodiments and the modified embodiment of the present invention is applied.

A digital camera 200 comprises, as shown in FIGS. 18A and 18B, a lens part 201, an operation part 202, a display part 203, and a finder 204. The display device 1 described in the above embodiments is applied to the display part 203. Then, with less deterioration in display quality due to deterioration over time of the display device 1, the display part 203 has the capability of light emission with proper luminance corresponding to image data over a prolonged time period.

In FIG. 19, a personal computer 210 comprises a display part 211 and an operation part 212. The display device 1 described in the above embodiments is applied to the display part 211. Then, with less deterioration in display quality due to deterioration over time of the display device 1, the display part 211 has the capability of light emission with proper luminance corresponding to images over a prolonged time period.

A cell-phone 220 shown in FIG. 20 comprises a display part 221, an operation part 222, an earpiece 223, and a mouthpiece 224. The display device 1 described in the above embodiments is applied to the display part 221. Then, with less deterioration in display quality due to deterioration over time of the display device 1, the display part 221 has the capability of light emission with proper luminance corresponding to image data over a prolonged time period.

In the above embodiments, the display device comprises a display panel having multiple pixels arranged two-dimensionally. However, the present invention is not restricted thereto. The structure according to the present invention is applicable to an exposure device in which, for example, multiple pixels having light emitting elements are arranged in one direction to construct an array of light emitting elements and a photoconductor drum is exposed to light emitted from the array of light emitting elements according to image data.

Each of the above embodiments and modified embodiment is able to easily measure a current flowing in light emitting elements. Furthermore, each of the above embodiments and modified embodiment is able to, using the measured current, properly detect change in the luminous efficiency of the light emitting elements using a relatively simple structure, compensate reduction in the luminous efficiency due to deterioration over time of the light emitting elements so as to prevent deterioration over time in the luminance.

Having described and illustrated the principles of this application by reference to one (or more) preferred embodiment(s), it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A light emitting device, comprising:

at least one data line;

at least one pixel connected to the data line;

a common electrode;

a data driver which applies a first voltage to the data line; and an ammeter connected to the common electrode at a first end of the ammeter;

wherein the pixel comprises a pixel drive circuit and a light emitting element, in which (a) the pixel drive circuit includes a first transistor electrically connected to (i) the data line and (ii) a first end of the light emitting element, and (b) a second end of the light emitting element is connected to the common electrode; and wherein the ammeter measures a current value of a detection current flowing from the data driver to the ammeter via the data line, the first transistor, the light emitting element of the pixel, and the common electrode when the data driver applies to the data line a first set voltage having a potential such that a forward bias voltage is applied between the first and second ends of the light emitting element via the first transistor as the first voltage.

2. The light emitting device according to claim 1, further comprising:

a luminous efficiency acquisition part which acquires a luminous efficiency indicating a ratio of a luminance of the light emitting element of the pixel with respect to an initial luminance of the light emitting element having initial properties based on the current value of the detection current measured by the ammeter; and a correction calculation circuit which generates corrected voltage data by correcting voltage data which corresponds to luminous gradation of image data supplied from an external source based on the luminous efficiency acquired by the luminous efficiency acquisition part.

3. The light emitting device according to claim 2, further comprising a power driver outputting a second voltage;

wherein the pixel drive circuit comprises a second transistor which is electrically connected to (a) the first end of the light emitting element and (b) the power driver via a power terminal of the pixel drive circuit; and wherein the power driver applies, as the second voltage, to the power terminal a second set voltage which has a potential such that a difference of potential between (a) the power terminal and (b) the first end of the light emitting element causes no current flows through the second transistor when the ammeter measures the current value of the detection current for acquiring the luminous efficiency.

4. The light emitting device according to claim 3, wherein, when the light emitting element emits light with luminance corresponding to the luminous gradation of the image data, the data driver applies to the data line a signal voltage corresponding to the corrected voltage data as the first voltage; and wherein the power driver applies, as the second voltage, to the power terminal a third set voltage which is different from the second set voltage and has a potential such that a forward bias voltage is caused to be applied between the the first and second ends of the light emitting element via the second transistor.

5. The light emitting device according to claim 4, further comprising a potential setting circuit which sets a potential of a second end of the ammeter;

wherein, when the ammeter measures the current value of the detection current, the potential setting circuit sets the second end of the ammeter to a fifth set voltage which is equal to the second set voltage, or has a potential such that a difference of potential between (a) the power terminal and (b) the first end of the light emitting element causes no current flows through the second transistor, and wherein, when the light emitting element emits light, the potential setting circuit sets the second end of the ammeter to a sixth set voltage which is different from the fifth set voltage and has a potential such that a forward bias voltage is caused to be applied between the first and second ends of the light emitting element via the second transistor.

6. The light emitting device according to claim 2, further comprising:

a plurality of the pixels; and a plurality of the data lines each corresponding to each of the pixels respectively;

wherein the second end of the light emitting element of each of the plurality of pixels is connected to the common electrode; and wherein the data driver, for acquiring the luminous efficiency, (a) applies the first set voltage as the first voltage to at least one specific data line among the plurality of data lines and (b) applies to the data lines other than the specific data line a fourth set voltage which has a potential such that a difference of potential between the first and second ends of the light emitting element causes no current flows through the light emitting element as the first voltage.

7. The light emitting device according to claim 6, further comprising a select driver, wherein:

the plurality of pixels are arranged two-dimensionally in a plurality of rows and a plurality of columns;

the data lines are arranged along the plurality of columns, respectively;

the select driver sets the pixels in a specific row among the plurality of rows to a selected state;

the data driver (a) applies the first set voltage as the first voltage to a specific data line among the plurality of data lines and (b) applies the fourth set voltage as the first voltage to the data lines other than the specific data line;

the ammeter measures a current value of a first detection current flowing from the data driver to the ammeter via a specific pixel, which is connected to the specific data line, in the specific row set to the selected state; and the luminous efficiency acquisition part acquires the luminous efficiency of the light emitting element of the specific pixel based on the current value of the first detection current measured by the ammeter.

8. The light emitting device according to claim 6, further comprising a select driver, wherein:

the plurality of pixels are arranged two-dimensionally in a plurality of rows and a plurality of columns;

each row has a given number of the pixels;

the data lines are arranged along the plurality of columns, respectively;

the select driver sets the pixels in a specific row among the plurality of rows to a selected state;

the data driver applies the first set voltage to all of the plurality of data lines;

the ammeter measures a current value of a second detection current flowing from the data driver to the ammeter via the given number of pixels in the specific row set to the selected state; and the luminous efficiency acquisition part acquires an average value of the luminous efficiency of the light emitting elements of the pixels in the specific row based on a value obtained by dividing the current value of the second detection current measured by the ammeter by the given number.

9. The light emitting device according to claim 6, further comprising a select driver, wherein:

the plurality of pixels are arranged two-dimensionally in a plurality of rows and a plurality of columns;

the data lines are arranged along the plurality of columns, respectively;

the select driver simultaneously sets the pixels in a group of two or more rows among the plurality of rows to a selected state;

the data driver (a) applies the first set voltage as the first voltage to a group of two or more of the data lines among the plurality of data lines and (b) applies the fourth set voltage as the first voltage to the data lines other than the group of data lines;

the ammeter measures a current value of a third detection current flowing from the data driver to the ammeter via a group of pixels, which are connected to the group of data lines, in the group of rows set to the selected state; and the luminous efficiency acquisition part acquires an average value of the luminous efficiency of the light emitting elements of the pixels in the group of pixels based on a value obtained by dividing the current value of the third detection current measured by the ammeter by the number of pixels in the group of pixels.

10. The light emitting device according to claim 6, further comprising a select driver, wherein:

the plurality of pixels are arranged two-dimensionally in a plurality of rows and a plurality of columns;

the data lines are arranged along the plurality of columns, respectively;

the ammeter measures (a) a current value of a fourth detection current and (b) a current value of a fifth detection current when the luminous efficiency acquisition part acquires the luminous efficiency;

the luminous efficiency acquisition part acquires the luminous efficiency of the light emitting element of a specific pixel, which is connected to the specific data line, in a specific row among the plurality of rows based on a difference in current value between the fourth and fifth detection currents;

the fourth detection current is a current that flows from the data driver to the ammeter via a given number of pixels in rows set to a selected state and connected to the specific data line, when (a) the select driver sets the pixels in a group of two or more rows including the specific row to the selected state and (b) the data driver (i) applies the first set voltage as the first voltage to the specific data line and (ii) applies the fourth set voltage as the first voltage to the data lines other than the specific data line; and the fifth detection current is a current that flows from the data driver to the ammeter via a given number of pixels in the rows set to the selected state and connected to the specific data line, when (a) the select driver sets the pixels in the remaining rows other than the specific row from the group of rows to the selected state and (b) the data driver (i) applies the first set voltage as the first voltage to the specific data line and (ii) applies the fourth set voltage as the first voltage to the data lines other than the specific data line.

11. The light emitting device according to claim 6, further comprising a select driver, wherein:

the plurality of pixels are arranged two-dimensionally in a plurality of rows and a plurality of columns;

each row has a given number of the pixels;

the data lines are arranged along the plurality of columns, respectively;

the ammeter measures (a) a current value of a sixth detection current and (b) a current value of a seventh detection current when the luminous efficiency acquisition part acquires the luminous efficiency;

the luminous efficiency acquisition part acquires an average value of the luminous efficiency of the light emitting elements of the pixels in a specific row among the plurality of rows based on a value obtained by dividing a difference in current value between the sixth and seventh detection currents by the given number;

the sixth detection current is a current that flows from the data driver to the ammeter via the pixels in rows set to a selected state, when (a) the select driver sets the pixels in a group of two or more rows including the specific row to the selected state and (b) the data driver applies the first set voltage as the first voltage to all of the plurality of data lines; and the seventh detection current is a current that flows from the data driver to the ammeter via the pixels in the rows set to the selected state, when (a) the select driver sets the pixels in the remaining rows other than the specific row from the group of rows to the selected state and (b) the data driver applies the first set voltage as the first voltage to all of the plurality of data lines.

12. An electronic device comprising a display part which includes the light emitting device according to claim 1.

13. A drive control method for a light emitting device, the light emitting device comprising (a) at least one data line, (b) at least one pixel connected to the data line, (c) a common electrode, (d) a data driver applying a first voltage to the data line, and (e) an ammeter connected to the common electrode at a first end of the ammeter, wherein the pixel comprises a pixel drive circuit and a light emitting element, in which (a) the pixel drive circuit includes a first transistor electrically connected to (i) the data line and (ii) a first end of the light emitting element, and (b) a second end of the light emitting element is connected to the common electrode, and the drive control method comprising:

applying a first set voltage as the first voltage to the data line from the data driver, wherein the first set voltage has a potential such that a forward bias voltage is applied between the first and second ends of the light emitting element via the first transistor; and measuring a current value of a detection current flowing from the data driver to the ammeter via the data line, pixel drive circuit and light emitting element of the pixel, and common electrode by the ammeter.

14. The drive control method according to claim 13, further comprising:

acquiring a luminous efficiency indicating a ratio of a luminance of the light emitting element of the pixel with respect to an initial luminance of the light emitting element having initial properties based on the current value of the detection current measured by the ammeter; and generating corrected voltage data by correcting voltage data which corresponds to luminous gradation of image data supplied from an external source based on the acquired luminous efficiency.

15. The drive control method according to claim 14, wherein the pixel drive circuit further comprises a second transistor which is electrically connected to (a) the first end of the light emitting element and (b) the power driver via a power terminal of the pixel drive circuit; and wherein the acquiring the luminous efficiency comprises applying to the power terminal a second set voltage which has a potential such that a difference of potential between (a) the power terminal and (b) the first end of the light emitting element causes no current flows through the second transistor.

16. The drive control method according to claim 14, wherein the light emitting device comprises (a) a plurality of the pixels and (b) a plurality of the data lines each corresponding to each of the pixels respectively, in which the second end of the light emitting element of each of the plurality of pixels is connected to the common electrode; and wherein the acquiring the luminous efficiency comprises (a) applying the first set voltage as the first voltage to at least one specific data line among the plurality of data lines and (b) applying to the data lines other than the specific data line a fourth set voltage which has a potential such that a difference of potential between the first and second ends of the light emitting element causes no current flows through the light emitting element as the first voltage.

17. The drive control method according to claim 16, wherein in the light emitting device, (a) the plurality of pixels are arranged two-dimensionally in a plurality of rows and a plurality of columns, (b) the data lines are arranged along the plurality of columns, respectively, and (c) a select driver for setting the pixels to a selected state is provided; and wherein the drive control method further comprises:

setting the pixels in a specific row among the plurality of rows to the selected state by the select driver;

(a) applying the first set voltage as the first voltage to a specific data line among the plurality of data lines and (b) applying the fourth set voltage as the first voltage to the data lines other than the specific data line by the data driver;

measuring, by the ammeter, a current value of a first detection current flowing from the data driver to the ammeter via a specific pixel, which is connected to the specific data line, in the specific row set to the selected state; and acquiring the luminous efficiency of the light emitting element of the specific pixel based on the current value of the first detection current measured by the ammeter.

18. The drive control method according to claim 16, wherein in the light emitting device, (a) the plurality of pixels are arranged two-dimensionally in a plurality of rows and a plurality of columns, (b) a given number of the pixels are arranged in each row, (c) the data lines are arranged along the plurality of columns, respectively, and (d) a select driver for setting the pixels to a selected state is provided; and wherein the drive control method further comprises:

setting the pixels in a specific row among the plurality of rows to the selected state by the select driver;

applying the first set voltage to all of the plurality of data lines by the data driver;

measuring, by the ammeter, a current value of a second detection current flowing from the data driver to the ammeter via the given number of pixels in the specific row set to the selected state; and acquiring an average value of the luminous efficiency of the light emitting elements of the pixels in the specific row based on a value obtained by dividing the current value of the second detection current measured by the ammeter by the given number.

19. The drive control method according to claim 16, wherein in the light emitting device, (a) the plurality of pixels are arranged two-dimensionally in a plurality of rows and a plurality of columns, (b) the data lines are arranged along the plurality of columns, respectively, and (c) a select driver for setting the pixels to a selected state is provided; and wherein the drive control method further comprises:

simultaneously setting the pixels in a group of two or more rows among the plurality of rows to the selected state by the select driver;

(a) applying the first set voltage as the first voltage to a group of two or more of the data lines among the plurality of data lines and (b) applying the fourth set voltage as the first voltage to the data lines other than the group of data lines by the data driver;

measuring, by the ammeter, a current value of a third detection current flowing from the data driver to the ammeter via a group of pixels, which are connected to the group of data lines, in the group of rows set to the selected state; and acquiring an average value of the luminous efficiency of the light emitting elements of the pixels in the group of pixels based on a value obtained by dividing the current value of the third detection current measured by the ammeter by the number of pixels in the group of pixels.

20. The drive control method according to claim 16, wherein in the light emitting device, (a) the plurality of pixels are arranged two-dimensionally in a plurality of rows and a plurality of columns, (b) the data lines are arranged along the plurality of columns, respectively, and (c) a select driver for setting the pixels to a selected state is provided;

wherein the drive control method further comprises:

(a) measuring a current value of a fourth detection current and measuring a current value of a fifth detection current by the ammeter; and (b) acquiring the luminous efficiency of the light emitting element of a specific pixel, which is connected to the specific data line, in a specific row among the plurality of rows and based on a difference in current value between the fourth and fifth detection currents;

wherein the measuring the current value of the fourth detection current comprises:

(a) setting the pixels in a group of two or more rows including the specific row to the selected state by the select driver;

(b) (i) applying the first set voltage as the first voltage to the specific data line and (ii) applying the fourth set voltage as the first voltage to the data lines other than the specific data line by the data driver; and (c) measuring the current value of the fourth detection current flowing from the data driver to the ammeter via a given number of pixels in the rows set to the selected state and connected to the specific data line by the ammeter; and wherein the measuring the current value of the fifth detection current comprises:

(a) setting the pixels in the remaining rows other than the specific row from the group of rows to the selected state by the select driver;

(b) (i) applying the first set voltage as the first voltage to the specific data line and (ii) applying the fourth set voltage as the first voltage to the data lines other than the specific data line by the data driver; and (c) measuring the current value of the fifth detection current flowing from the data driver to the ammeter via a given number of pixels in the rows set to the selected state and connected to the specific data line by the ammeter.

21. The drive control method according to claim 16, wherein in the light emitting device, (a) the plurality of pixels are arranged two-dimensionally in a plurality of rows and a plurality of columns, (b) a given number of the pixels are arranged in each row, (c) the data lines are arranged along the plurality of columns, respectively, and (d) a select driver for setting the pixels to a selected state is provided;

wherein the drive control method further comprises:

(a) measuring a current value of a sixth detection current and measuring a current value of a seventh detection current by the ammeter; and (b) acquiring an average value of the luminous efficiency of the light emitting elements of the pixels in a specific row among the plurality of rows based on a value obtained by dividing a difference in current value between the sixth and seventh detection currents by the given number;

wherein the measuring the current value of the sixth detection current comprises:

(a) setting the pixels in a group of two or more rows including the specific row to the selected state by the select driver;

(b) applying the first set voltage as the first voltage to all of the plurality of data lines by the data driver; and (c) measuring the current value of the sixth detection current flowing from the data driver to the ammeter via the pixels in the rows set to the selected state by the ammeter; and wherein the measuring the current value of the seventh detection current comprises:

(a) setting the pixels in the remaining rows other than the specific row from the group of rows to the selected state by the select driver;

(b) applying the first set voltage as the first voltage to all of the plurality of data lines by the data driver; and (c) measuring the current value of the seventh detection current flowing from the data driver to the ammeter via the pixels in the rows set to the selected state by the ammeter.

* * * * *